US011542130B2

(12) United States Patent
Woldring et al.

(10) Patent No.: US 11,542,130 B2
(45) Date of Patent: Jan. 3, 2023

(54) EXTENDABLE BOOM WITH A LOCKING SYSTEM AND METHOD FOR OPERATING AN EXTENDABLE BOOM OF A CRANE

(71) Applicant: GustoMSC Resources B.V., Schiedam (NL)

(72) Inventors: Wilhelmus Coenradus Johannes Jozephus Woldring, Schiedam (NL); Mark Cornelius Marinus Franciscus Rommens, Schiedam (NL); Adriaan Joost Van Putten, Schiedam (NL)

(73) Assignee: GUSTOMSC B.V., Schiedam (NL)

( * ) Notice: Subject to any disclaimer, the term of this patent is extended or adjusted under 35 U.S.C. 154(b) by 83 days.

(21) Appl. No.: 16/334,305

(22) PCT Filed: Jun. 6, 2017

(86) PCT No.: PCT/NL2017/050370
§ 371 (c)(1),
(2) Date: Mar. 18, 2019

(87) PCT Pub. No.: WO2018/052283
PCT Pub. Date: Mar. 22, 2018

(65) Prior Publication Data

US 2019/0218075 A1 Jul. 18, 2019

(30) Foreign Application Priority Data

Sep. 19, 2016 (NL) ..... 2017498

(51) Int. Cl.
*B66C 23/70* (2006.01)
*B66C 13/46* (2006.01)
(Continued)

(52) U.S. Cl.
CPC ..... *B66C 23/708* (2013.01); *B66C 13/46* (2013.01); *B66C 23/16* (2013.01); *B66C 23/703* (2013.01); *B66C 23/707* (2013.01); *B66C 23/82* (2013.01)

(58) Field of Classification Search
CPC ..... B66C 23/16; B66C 23/703; B66C 23/707; B66C 23/708; B66C 23/82; B66C 23/04;
(Continued)

(56) References Cited

U.S. PATENT DOCUMENTS 3,830,376 A 8/1974 Fritsch
4,053,058 A 10/1977 Jensen et al.
(Continued)

FOREIGN PATENT DOCUMENTS

EP 1468955 A1 10/2004
JP S51145173 U 11/1976
(Continued)

OTHER PUBLICATIONS

JPH 10316367A Machine Translation (Year: 1998).*
(Continued)

*Primary Examiner* — Michael R Mansen
*Assistant Examiner* — Juan J Campos, Jr.
(74) *Attorney, Agent, or Firm* — Banner & Witcoff, Ltd.

(57) ABSTRACT

Telescopic lattice type crane boom for a crane, further comprising a locking system configured to lock at least one telescopic boom section with respect to a base boom section in at least an extended position, wherein said locking system includes a plurality of pins, each pin being configured to extend, in at least the extended position of the boom, at least partly through a corresponding pin receiving aperture provided in one of the base boom section and the at least one telescopic boom section.

23 Claims, 14 Drawing Sheets

(51) Int. Cl.
*B66C 23/82* (2006.01)
*B66C 23/16* (2006.01)

(58) Field of Classification Search
CPC ..... B66C 23/62; B66C 23/64; B66C 23/70; B66C 23/701
See application file for complete search history.

(56) References Cited

U.S. PATENT DOCUMENTS

| | | | | |
|---|---|---|---|---|
| 6,523,491 | B1 * | 2/2003 | Moise, II | B63B 35/00 114/265 |
| 7,156,245 | B2 | 1/2007 | Lissandre | |
| 7,344,037 | B1 * | 3/2008 | Zakula, Sr. | B66C 13/46 212/270 |
| 2012/0085722 | A1 | 4/2012 | Willim | |
| 2013/0115011 | A1 * | 5/2013 | Johnson | E02B 17/0836 405/196 |

FOREIGN PATENT DOCUMENTS

| | | | |
|---|---|---|---|
| JP | S59116396 | U | 8/1984 |
| JP | S628996 | A | 1/1987 |
| JP | S63119590 | U | 8/1988 |
| JP | S63183188 | U | 11/1988 |
| JP | H07109091 | A | 4/1995 |
| JP | H10316367 | A | 12/1998 |
| JP | 2004244196 | A | 9/2004 |

OTHER PUBLICATIONS

Sep. 13, 2017—International Search Report—Appl No. PCT/NL2017/050370.
Feb. 8, 2021—JP Office Action—JP 2019-536807.

* cited by examiner

EXTENDABLE BOOM WITH A LOCKING SYSTEM AND METHOD FOR OPERATING AN EXTENDABLE BOOM OF A CRANE

CROSS-REFERENCE TO RELATED APPLICATIONS

This application is a U.S. National Stage application under 35 U.S.C. § 371 of International Application PCT/NL2017/050370 (published as WO 2018/052283 A9), filed Jun. 6, 2017, which claims the benefit of priority to Application NL 2017498, filed Sep. 19, 2016. Benefit of the filing date of each of these prior applications is hereby claimed.

The invention relates to an extendable lattice type boom for a crane. In many fields of construction and maintenance there is a demand for ever larger cranes capable of hoisting loads at increasing heights. This requires the use of a longer boom, or an extension attached to a boom, such as a jib. Increasing the length of the boom will inevitably introduce a hindrance for transportation of the crane.

Cranes with a telescopic boom have been developed to achieve relatively large lifting heights while being able to quickly retract the boom to transportable dimensions. Such telescopic booms usually have two or more sections with decreasing dimensions, the larger section enclosing the inserted part of the smaller section. The loads on the boom, such as the weight of the boom and the hook load, will result in a bending or overturning moment in the boom and therefore between the sections, which will result in large forces being transferred through the guides between the telescoping sections, requiring significant material strength at the guides.

In general, a longer boom requires a heavier construction to be able to withstand not only the increased forces and bending moment induced by a hook load at a larger outreach of the crane, but also to support its own increased weight. When increasing the length of a conventional tubular type telescopic boom, such tubular boom may become too heavy for certain applications such as off-shore applications when taking into account the required material strength at the guides.

Application of a lattice type boom can reduce the weight of the boom significantly in view of the tubular type boom. A telescoping boom with lattice type sections has been disclosed, but connecting and/or locking the telescopic boom sections remains problematic. Also, load transfer to the telescopic boom sections may remain difficult.

In the field of wind turbine installation, it is expected that the required lifting height for installing the turbine on top of the tower will increase to 140-160 m, or beyond, in the near future. For onshore installation of wind turbines, for which usually conventional mobile cranes with telescopic boom are used, this lifting height would require the largest available conventional mobile telescopic cranes with additional lattice jib and luffing systems.

For offshore installation of wind turbines, jack-up platforms carrying lattice boom type cranes with boom hoist wires are generally used. The expected lifting heights for future installations exceed the current capabilities of the available cranes on existing installation jack-up platforms. If a lattice boom of such a lattice boom type crane were extended with an additional section, the longer boom would then protrude from its original boom rest in a transit position and the crane block would not fit its original support. This could result in increased bending moment in the boom during transit. Also, the protruding boom may not fit within the footprint of the jack-up platform any more and may extend outwardly thereof, which may cause stability problems during transit of the platform and/or may result in an increased bending moment in the boom. Additionally, the protruding boom can also cause logistic problems on the platform itself, such as the boom blocking the helicopter platform.

It is an objective to provide for an extendable lattice boom which obviates at least one of the above mentioned drawbacks.

There is disclosed an extendable lattice type boom for a crane comprising a base boom section and at least one telescopic boom section including the features of claim 1. The extendable lattice type crane boom comprises a lattice type base boom section and at least one lattice type telescopic boom section. A lattice type boom section generally comprises a plurality of longitudinal chords interconnected with trusses. The chords generally form the corners of the boom's cross-section, which may have a triangular, rectangular, or square shape, or any other desired, usually polygonal, cross-sectional shape. The at least one telescopic boom section is adjustable with respect to the base boom section between a retracted position, in which the telescopic boom section is substantially inside of the base boom section, and an extended position, in which the telescopic boom section is at least partly outside of the base boom section. The extended position can be a maximally extended position, in which there is only a minimal overlap between the base boom section and the telescopic boom section, or can also be any other intermediate extended position, in which a larger part of the telescopic boom section is still inside the base boom section. The extendable crane boom further comprises a locking system configured to lock the at least one telescopic boom section with respect to the base boom section in at least the extended position. Said locking system includes a plurality of pins, each pin being configured to extend, in at least the extended position of the boom, at least partly through a corresponding pin receiving aperture provided in one of the base boom section and the at least one telescopic boom section. In an inventive way, a size of at least one of said pin receiving apertures is substantially larger than a cross-sectional dimension of a corresponding one of said plurality of pins to be received in the pin receiving aperture.

The pin receiving aperture can have various forms, e.g. a substantially round hole, or a slotted hole, or an egg-shaped hole, or any other variant of a hole in which in at least one radial direction, the dimension of the hole is substantially larger than a cross-section of the corresponding pin as to provide sufficient play in the connection.

In particular, in at least one radial direction of the pin receiving aperture the dimension of the pin receiving aperture is substantially larger than a cross-section of the pin. For example, the pin receiving aperture can be a slotted hole, that in at least one direction, i.e. in longitudinal direction of the hole, is substantially larger than a cross-section of the pin. Substantially larger is understood to be larger than normal tolerances available to allow a pin to be received in a hole. For example, the additional dimension, i.e., the size of the pin receiving aperture that is larger than the cross-section of the pin, resulting in additional play, in the at least one direction can be about 10 mm to about 40 mm, Advantageously, the additional dimension, or the difference in size between the length of the pin receiving aperture and the cross-section of the pin in a certain direction, is provided at both sides of the pin at a position where the pin is inserted in the aperture to allow for easy insertion. For example the additional dimension can be between about 10 mm to about 40 mm at each side. More preferably, the additional dimension can be between about 15 mm to about 35 mm. The additional dimension is advantageously independent of the size and/or cross-sectional shape of the pin, but allows for easy insertion independent of the size and/or cross-sectional shape, e.g. circular or square, of the pin. The additional dimension can be provided in one direction, e.g. resulting in a slotted hole or an oval hole or an egg-shaped hole, or can be provided in more than one radial direction with respect to the cross-section of the pin, or can be provided in all radial directions of the hole, resulting in an enlarged hole with respect to the cross-sectional dimension of the pin.

In this way, an extendable crane boom can be obtained, which can be solidly locked in an extended position in a relatively quick and easy way, while still remaining transportable as it is a retractable and relatively light-weight structure. Also, the locking and/or unlocking of the telescopic boom section from the base boom section can be done relatively simple and fast, reducing time between subsequent working operations. In particular when the crane with the extendable crane boom is installed on a jack-up platform that is working on subsequent installation sites offshore, such as for example in a wind-mill park, a relatively short retracting and/or extending of the telescopic boom section is advantageous reducing the turnaround time between subsequent installation sites.

Advantageously, an at least one primary pin can be provided that is adapted to be received in a corresponding primary pin receiving aperture and an at least one secondary pin can be provided that is adapted to be received in a corresponding secondary pin receiving aperture. Preferably, the primary pins are inserted first into the corresponding apertures. The corresponding primary pin receiving apertures are preferably slotted or egg-shaped, or droplet shaped such that the pin can be received at the larger part of the egg-shaped aperture and then, upon further locking of the connection, the pin moves to the smaller part of the egg-shaped opening as to align and lock the pin in the aperture. To provide for the movement and alignment, the egg-shaped hole has oblique sides with respect to a longitudinal direction of the hole, approximately with an angle between about 2 deg to about 10 deg with respect to the longitudinal direction of the aperture. The primary pin and the corresponding primary pin receiving aperture can be provided at an upper chord of the base boom section and the telescopic section and/or at a lower chord of the base boom section and the telescopic section. The pin can thus be firmly received in the smaller part of the egg-shaped or droplet-shaped aperture such that load, e.g. axial and/or transverse, can be transferred. These primary pins may be provided in an upper chord, when boom hoist wires are connected to the telescopic section. To optimize load transfer, the shape of the smaller part of the egg-shaped opening mainly corresponds to the cross-sectional shape of the pin to be received in the aperture. In an embodiment, there may be primary pins provided in a lower chord as well, when boom hoist wires are connected to the telescopic section. Such primary pins may be subject to axial loading only. These primary pins may have for example a rectangular shape and the corresponding pin receiving aperture may have a rectangular shape as well that has a size that is substantially larger than the cross-sectional dimension of the pin, e.g. the pin receiving aperture may be in two perpendicular dimensions, i.e. transverse to the sides of the rectangle, at both sides of the rectangle, larger than the cross-section of the pin with an additional dimension of between about 10 mm to about 40 mm to allow easy insertion. In use, a side of the pin abuts against a side of the aperture to allow load transfer.

In a further embodiment, there may be provided at least one secondary pin with a corresponding at least one pin receiving aperture. Such a secondary pin may be provided in a lower chord as well, when boom hoist wires are connected to the telescopic section. The secondary pin may be subject to axial loading only. Also, such a secondary pin may advantageously be of a rectangular cross-section with a corresponding rectangular shaped pin receiving aperture. The secondary pin may provide for axial locking of the base boom section with the telescopic boom section together with the primary pin in the, in this embodiment, lower chord.

Various embodiments and combinations are possible. For example, the boom hoist wires may be connected to the base boom section and to the telescopic section. In this embodiment, the at least one secondary locking pin with corresponding pin receiving aperture may be provided in lower chords of the base boom section and the telescopic section. Additionally, an at least one primary pin and corresponding pin receiving aperture may be provided in the lower chords, together providing for axial locking. While an at least one primary pin and corresponding pin receiving aperture can be provided in the upper chords of the base boom section and the telescopic section. In another embodiment, the boom hoist wires are connected to the telescopic section only. In this embodiment, an at least one secondary pin and corresponding pin receiving aperture may be provided in the lower chords, similar to the previous embodiment. In another embodiment, the boom hoisting wires are connected to the base boom section only. In this embodiment, an at least one secondary pin and corresponding pin receiving aperture may be provided in the upper chords. Additionally, in the upper chords an at least one primary pin and corresponding primary pin receiving aperture can be provided, together providing for axial locking of the base boom section and the telescopic boom section. An at least one primary pin with corresponding primary pin receiving aperture is then provided in the lower chords. S aid locking system can comprise a support structure from which the plurality of pins extend. Said support structure is preferably provided at a distal end of the base boom section. Alternatively, the support structure could also be provided at a proximal end of the telescopic boom section. In the latter case, the pins extend outwardly to be received in corresponding apertures in the base boom section. In the former case, the pins extend inwardly to be received in corresponding apertures in the telescopic boom section. The support structure can have a shape that is similar to a cross-section of the crane boom, for example a rectangular shape or any other desired shape. The corners of said support structure can be in line with the longitudinal chords of the boom. The support structure can for example be a solid and reinforced structure, or alternatively an open structure including chords and trusses with local reinforcement elements, e.g. to transfer loads from the pins to the chords and/or trusses. The support structure can provide a relatively solid locking system of the extendable boom. In order to further reinforce the solidity of the locking system of the extendable boom, the corresponding pin receiving aperture may advantageously be provided at a chord of the telescopic boom section, preferably at a proximal end of the telescopic boom section, more preferably at a proximal end of every chord of the telescopic boom section. As an example, in case of an extendable boom with a substantially rectangular cross-section, the locking system can comprise four main pins extending at least partly into four main pin receiving apertures, i.e. one aperture in each of the four longitudinal chords of the telescopic boom section, each receiving one of the four main pins. A size of at least one of said four apertures is larger than a cross-section of the pin to be received, and preferably, a size of all four apertures is larger than the cross-section of the pin to be received.

More advantageously, the locking system can comprise a secondary set of pins and corresponding pin receiving apertures provided at a lower side of the base boom section and of the telescopic boom section, wherein preferably at least one of the pin receiving apertures has a size which is substantially larger than a cross-sectional dimension of the corresponding pin to be received. The corresponding pin receiving apertures for the set of secondary pins may be the same, or part of, the pin receiving apertures for the primary pins, or may be separate pin receiving apertures. When the pin receiving aperture for the secondary pin and the pin receiving aperture for the primary pin is the same, in fact a large aperture is provided in which the primary pin and the secondary pin can be received. The primary pin and the secondary pin preferably are each provided at opposite ends of the combined primary and secondary pin receiving aperture to provide for axial or chordwise locking.

A lower side of the extendable boom is a side which is turned downwards when the extendable boom is retracted and in a transport position. When the extendable boom, as part of a crane, is brought into a working position, which is a substantially upright but still slightly tilted position of the boom, said lower side is also the side on which loads can be hoisted. Said secondary set of pins and corresponding apertures can firmly lock the telescopic boom section to the base boom section substantially without play and can thus improve load transmission via the pins to the chords of the base boom section.

The extendable lattice type crane boom can further comprise a guiding system configured to guide a movement of the telescopic boom section along the base boom section. Said guiding system may for example include guide rails and guide elements configured to be guided along the guide rails, or any other guiding system. Said guiding system can advantageously be provided on a chord of the base boom section and/or the telescopic boom section under an angle with respect to an upper or a lower side of the boom, preferably the angle is about 45°. Said angle allows an efficient guiding system which can be made relatively compact. An example of a guiding system will be discussed in more detail in the figures.

The extendable lattice type crane boom may further comprise a measuring system configured to detect a position of the telescopic boom section with respect to the base boom section. Such measuring system can for example include a camera for visual inspection, or a closed circuit TV system, or any other suitable measuring system. The measuring system can send feedback of its measurements to a control system, which may control the extension or retraction of the extendable boom, in a partly or entirely automated way, or under control of a human operator.

The extendable lattice crane boom can further comprise a telescopic system arranged to adjust the at least one telescopic boom section between said retracted position and said extended position, wherein said telescopic system comprises at least one reeving system. The reeving system can comprise a wire rope tackle system with a winch. The wire rope can be reeved between sheaves mounted inside the base boom section and sheaves mounted on a telescopic boom section. Pulling the wire rope in with the winch can for example result in the telescopic boom section being pulled out of the base boom section, thus extending the boom, while moving along the guides. During retraction of a telescopic boom section, the winch can be operated to release the wire rope allowing the telescopic boom section to move inside of the base boom section, typically moving down as a result of gravity. In alternative embodiments, the telescopic system may comprise a hydraulic cylinder or a rack & pinion system, instead of a reeving system. The telescopic system can preferably comprise two reeving systems, each provided on an opposite side of the base boom section, preferably on lateral sides of the base boom section, which is advantageous for a balanced load distribution. Preferably there is a single winch for the two reeving systems such that the two reeving systems in fact form a single combined telescopic system provided at both sides of the base boom section.

There is also disclosed a locking system for an extendable lattice type crane boom, including features described throughout the specification and original claims. Such a locking system can provide a solid locking of an extendable boom in at least an extended position, and is relatively easy and quick in operation. An extendable lattice type crane boom can also comprise a plurality of telescopic boom sections, wherein each telescopic boom section is lockable with a contiguous telescopic boom section via such a locking system. In this way, a still larger and/or compacter extendable crane boom can be provided.

According to an aspect of the invention, a crane is disclosed having features described throughout the specification and original claims. The crane comprises an extendable lattice type crane boom as described above. Said lattice type boom is movable between a transit position, in which said lattice type boom is in a substantially retracted and substantially horizontal position, and a working position, in which the lattice type boom is extended. The crane also comprises a crane base to which said extendable lattice type boom is pivotably connected, such that the crane boom can be rotated around a substantially horizontal axis between said transit position and said working position. The crane base can optionally also be made rotatable around a substantially vertical axis. The crane further comprises a boom hoisting system arranged to rotate the extendable boom between said transit position and said working position, and a load hoisting system configured to hoist a load. The boom hoisting system can preferably be connected to a distal end of the base boom section as well as to a distal end of the telescopic boom section, which can provide a relatively stable, well-balanced and reliable crane. Alternatively, the boom hoisting system may also be connected to one of a distal end of the base boom section and a distal end of the telescopic boom section. The boom hoisting system may also be configured to be controlled by a control unit during operation of the telescopic system to follow the telescopic system to facilitate the movement of the telescopic boom section. As such, the telescopic system acts as a master system, while the boom hoisting system acts as a slave system that follows the operation of the master system to facilitate the movement of the telescopic system. Thus, the crane operator may only need to operate the telescopic system while the boom hoisting system follows automatically, controlled by a control unit, to facilitate movement of the telescopic boom section. As such, an optimal angle of about 80° of the crane boom can be kept during the telescopic operation. Also, providing the boom hoisting system as a slave system to the master system, at least during telescopic operation, provides for a more easy operation of the crane by the crane operator, as the operator then has to operate the telescopic reeving system only. This may reduce the risk on failures and/or mistakes.

Advantageously, a measurement system can be provided to determine the actual position of the telescopic crane boom section with respect to the base boom section. The measurement can provide feedback on the actual position to the crane operator who can adapt the crane operations on that information. Also, the measurement system can be configured to control a speed reduction of the telescopic system upon approaching a desired extended position. This may assist the crane operator in approaching the desired extended position and may reduce the risk on failures or damages.

The control unit for controlling the operation of the boom hoisting system in dependency of the operation of the telescopic reeving system can be part of the measurement system of may be provided as a separate control unit. In a preferred embodiment, a measurement system is provided that is configured to control the operations of the crane and provide output on measured parameters, such as telescopic boom speed to an output unit, e.g. the user interface of the crane operator.

In a preferred embodiment of the crane, the crane base can be mountable around a leg of a jack up platform. Such a crane can provide a relatively compact yet efficient crane, even in a harsh off-shore environment. The crane base may also be mountable on a standard pedestal with a slewing bearing arrangement. However, providing the crane base around a leg of the jack-up platform provides for a space efficient solution for the use of the space on a deck of the jack-up platform.

According to a further aspect of the invention, there is disclosed a method for operating a crane including an extendable lattice type crane boom, providing one or more of the above-mentioned advantages.

According to a further aspect of the invention, there is a disclosed jack up platform comprising a crane having features described throughout the specification and original claims, and providing one or more of the above-mentioned advantages.

According to an alternative embodiment, an extendable or telescopic boom with a base boom section and at least one telescopic boom section is proposed. As previously described, the sections are of a lattice type construction with a square, rectangular or possibly triangular cross section, with longitudinally extending chords in each corner of the cross-section which are connected to each other with trusses. The telescopic section has smaller cross-sectional dimensions in comparison with the base boom section, which base boom section at least partly encloses the inserted part of the telescopic boom section. The telescopic section can be moved relative to the base boom section in order to extend or shorten the boom. The telescopic boom section is adjustable with respect to the base boom section between a retracted position, in which the telescopic boom section is substantially inside of the base boom section, and an extended position, in which the telescopic boom section is substantially outside of the base boom section. The telescopic boom section is preferably locked with respect to the base boom section in at least an extended position, but may also be lockable in intermediate positions and/or in a retracted position.

Typically, the extendible boom is provided with hoisting elements to which a hoisting system can be mounted that is connectable to a crane base, preferably to winches at the crane base. In a mounted position, when the boom is mounted to a crane base, one or more chords of the boom are upper chords at the side where the boom is provided with the hoisting elements. The chords at an opposite side thereof are, in mounted condition, the lower chords.

The extendable boom may also comprise multiple telescopic boom sections with decreasing dimensions, preferably with decreasing cross-sectional dimensions, and/or with similar or decreasing longitudinal dimensions, each being movable relative to the other in order to extend or retract the boom. Guides are provided for guiding the movement of the telescopic boom section along the base boom section. Guide rails can be provided on the chords of the telescopic boom section and corresponding guides can be positioned inside the base boom section. Alternatively, the guides can be provided on the chords of the telescopic boom section and the corresponding guide rails can be positioned inside the base boom section. In case the extendable boom has multiple sections, the same guiding configuration is applied between each successive sections. The guides may be used for moving each telescopic boom section with respect to the base boom section, or preceding boom section.

The extendable boom is preferably equipped with a telescopic system arranged to extend or retract each telescopic boom section out of and/or into a preceding telescopic boom section or the base boom section. The telescopic system may comprise a reeving system, as previously described.

In case the boom has multiple telescopic boom sections, each telescopic boom section may be provided with an additional telescopic system between the telescopic boom sections, or a single telescopic system may be configured to extend and/or retract multiple telescopic boom sections. The telescoping system can be arranged to extend the telescopic boom sections simultaneously and/or sequentially.

The extendable boom is preferably provided with a locking system arranged for connecting and/or locking the chords of the telescoping part to the base boom section, or a preceding telescopic boom section, in order to provide for a firm connection between the respective telescopic boom sections such that boom load can be transferred through the chords. The locking system may comprise a support structure at a distal end of the base boom section or the preceding telescopic boom section, which support structure is provided with locking pins. The locking pins are positioned to align with apertures in the chords of the telescopic boom section that is at least partly inserted in the base boom section. The telescopic boom section is provided with apertures arranged in or integrated with the chords to receive the locking pins. The locking pins can be engaged with hydraulic or electric actuating means. The support structure can be provided at the distal end of the base boom section with the locking pins connected thereto and extending therefrom towards a chord of the telescopic boom section. Alternatively, the support structure can be provided at the proximal end of the telescopic boom section with the locking pins connected thereto and extending therefrom towards a chord of the base boom section, or preceding telescopic boom section. Alternatively, the support structure can be provided at the distal end of the base boom section with the locking pins connected to the telescopic boom section, e.g. at the chords of the telescopic boom section, and extending therefrom towards the support structure.

The telescopic boom section can be locked with respect to the base boom section in at least an extended position. However, locking in the retracted position and/or in intermediate positions may also be possible. Alternative to locking of the telescopic boom section in the retracted position, there may be a stop element provided against which the telescopic boom section may abut as to position the telescopic boom section in the retracted position.

To enable locking at these positions, the telescopic boom section may be provided with multiple apertures arranged for receiving a locking pin from the locking system. The apertures of the telescopic boom section are preferably provided at predetermined positions on the chords thereof, such that they can receive a locking pin in a required position of the telescopic boom section.

The locking pins are engageable in the retracted and/or extended and/or intermediate position of the telescopic boom section with respect to the base boom section. When at least one locking pin is engaged, the guides can be retrieved from the guide rails to undo the contact between the guides and the guide rails. As such, the boom load may be directly transferred via the locking pins through the chords and no or minimal load transfer may go through the guides of the guiding system. So, the guide rails may not support the load in the extended position of the boom. This is advantageous for the mechanical structure of the boom for which less or reduced reinforcement may be required, allowing the mechanical structure to become lighter in view of prior art structures. When the locking pins are engaged, the telescopic system need not be actuated anymore, so load transfer is mainly done via these locking pins through the chords, instead of via the guides and/or via the telescopic system. Basically, the guides and/or the telescopic system may not be subject to boom loads in the extended position.

In case the boom has multiple telescopic boom sections, a locking system is provided at each transition between successive telescopic boom section, with the support structure and locking pins at the top end of each telescopic boom section.

For example, the extendable crane may have boom hoist wires connected to the boom tip. The upper chords, i.e. the chords of the boom sections at the side of the boom sections provided with hoisting elements, may then be under compression. The apertures in the upper chord for receiving the locking pins may be slotted holes to allow easy insertion of the upper locking pins during extending. Alternatively, the boom hoist wires can be connected to the base boom section. The telescopic part may now be subject to an additional bending moment resulting in the lower chords, i.e. the chords of the boom sections at a side opposite of the upper chords, being under compression. In this case the apertures in the lower chords for receiving the lower locking pins may be slotted for easy insertion during extending.

It is noted that the apertures arranged on the chords of a telescopic boom section which correspond with the retracted position of the telescopic boom section may have the form of a slotted hole to provide for easy insertion of the locking pins during extension, if locking in a retracted position is provided.

In order to enable insertion of a locking pin into a pin receiving aperture on the telescopic boom section, the base boom section and the telescopic boom section are preferably properly aligned. During extension and/or retraction of the telescopic boom section with respect to the base boom section, the guides are in contact with the guide rails for guiding the telescopic boom section during the telescopic movement. Due to the contact of the guides and the guide rails, the bending moment of the boom is transferred via the guides to the telescopic boom section during telescoping. By providing a locking system with locking pins, the chords of successive sections can be connected and locked in order to transfer boom loads via the pins through the chords. Upon locking of the locking pins, the contact between the guides and the guide rails can be undone, so as to transfer the load via the locking pins and such that the guides can become unloaded. The extendable boom is advantageously provided with an alignment system arranged to align the telescopic boom section with the base boom section as to enable proper locking of the telescopic boom section with respect to the base boom section in the determined position. The aligning system is arranged to push, or pull, the telescopic boom section in a direction transverse to the longitudinal chord direction, at the proximal end of the telescopic boom section such that a longitudinal center line of the telescopic boom section aligns with a longitudinal center line of the base boom section. A stop may be provided at an opposite end of the alignment system against which the telescopic boom section can abut during alignment, preferably the stop is retrievable such that, after alignment, there is no contact with the telescopic boom section. The alignment system may comprise at least an actuator, such as a hydraulic cylinder or electric actuator, mounted to the base boom section, or telescopic boom section, preferably at the side where, in an extended position, there is contact between the sections due to the bending moment of the base boom section and/or telescopic boom section. The alignment system, for example the actuator is capable of pushing, or pulling, the proximal end of the telescopic boom section away from the guides to undo the contact between the guides and the guide rails. This way the guides can be unloaded and the centerline of the telescopic boom section can be brought in alignment with the centerline of the base boom section.

Due to the alignment of the telescopic boom section with respect to the base boom section, the telescopic boom section may rotate around an axis transverse to its center line. Preferably, at least one aperture is provided as a slotted hole to allow the alignment rotation of the telescopic boom section when the locking pin is already engaged. Once the alignment is completed, the opposite locking pin may be engaged into a corresponding aperture. The opposite pin-and-aperture set may have mating dimensions such that the pin closely fits in the aperture, but preferably, all apertures in the chords of the telescopic boom section are not closely fitting apertures.

In the above, the telescopic boom section is explained as being extendible and/or retractable with respect to the base boom section. It is to be understood, that in case the boom has multiple telescopic boom sections, that a more distal telescopic boom section is extendible and/or retractable with respect to its preceding telescopic boom section in the same or similar manner.

In case the boom has multiple telescopic boom sections, an alignment system is provided at each transition between successive telescopic boom sections, with the alignment system mounted to the preceding telescopic boom section and arranged to align the distal telescopic boom section with respect to its preceding telescopic boom section.

Methods for operating an extendable boom are also proposed.

A first method comprises the sequence of operational steps during extension of the boom, using a locking system involving a crane with boom hoist wires attached to the boom tip and at least a telescopic boom section of which the upper chords are provided with apertures for receiving the locking pins which may be in the form of slotted holes, comprising the steps:

extending the telescopic part with the telescopic system by pulling in the wire rope inserting the upper locking pins into the corresponding slotted holes arranged in the upper chords of the telescopic boom section lowering the telescoping system until the telescopic boom section rests on the upper locking pins while the guides at the lower chords are supported by the guides inside the base boom section aligning the telescopic boom section with the base boom section, and thereby accurately positioning the lower locking pins over the corresponding apertures arranged on the lower chords of the telescoping section, by using the aligning system to push the telescopic part away from the guides while the telescopic boom section rotates around the upper locking pins inserting the lower locking pins into the corresponding apertures arranged on the lower chords.

A second method comprises the sequence of operational steps during extending the boom, using a locking system involving a crane with boom hoist wires attached to the top of the base boom section and at least a telescopic boom section of which at least the lower chords are provided with apertures for receiving the locking pins which are in the form of slotted holes, comprising the steps:

extending the telescopic part with the telescoping system by pulling in the wire rope of the telescopic system inserting the lower locking pins into the corresponding slotted holes arranged in the lower chords of the telescopic boom section lowering the telescoping system until the telescopic boom section rests on the lower locking pins while the guides at the upper chords are supported by the guides inside the base boom section aligning the telescopic boom section with the base boom section, and thereby accurately positioning the upper locking pins over the corresponding apertures arranged on the upper chords of the telescopic boom section, by using the aligning system to push the telescopic part away from the guides while the telescopic boom section rotates around the lower locking pins inserting the upper locking pins into the corresponding apertures arranged on the upper chords of the telescopic boom section.

A third method comprises the sequence of operational steps during retracting the boom comprising the steps of:

retracting the locking pins at the side at which the pins were inserted last during extension of the boom releasing the aligning system to re-establish the contact between the guides between the telescopic boom section and the base boom section retracting the remaining locking pins lowering the telescoping system until the telescopic boom section reaches the retracted position insert the locking pins into the apertures arranged in the chords of the telescopic boom section which correspond with the retracted position of the telescopic boom section, if locking in a retracted position is provided. Advantageously, prior to retracting the locking pins, the locking pin to be retracted is first unloaded as to be able to retract the pin. For unloading the locking pin, the telescopic system can be operated to adjust the telescopic boom as to unload the said locking pin. This can be done for each locking pin to be retracted, or for a set of locking pins at the same time. Advantageously, the locking pins are retracted in reverse order as they were inserted.

In case the boom has multiple telescopic boom sections, the method can be repeated for each consecutive telescopic boom section.

The disclosure will further be elucidated on the basis of exemplary embodiments given by way of non-limitative description and illustration. It is noted that the figures are only schematic representations of embodiments of the disclosure that are given by way of non-limiting example. Various modifications, variations, and alternatives are possible, as well as various combinations of the features described. The specifications, drawings and examples are, accordingly, to be regarded in an illustrative sense rather than in a restrictive sense. Embodiments according to the disclosure will, by way of non-limiting example be described in detail with reference to the accompanying drawings. In the drawings:

FIGS. 1*a* and 1*b* show a perspective view of a crane including an extendable crane boom according to an embodiment of the invention in a retracted and an extended position respectively;

FIGS. 2*a* and 2*b* show a side view on the crane of FIG. 1 in a retracted and an extended position respectively;

FIG. 3*a* shows a perspective view on an upper side of a telescopic boom section of the extendable boom in the crane of FIG. 1;

FIG. 3*b* shows a cross-sectional view of a base boom section and the telescopic boom section of the extendable boom in the crane of FIG. 1;

FIG. 4 shows a perspective view on part of the extendable boom in an extended position of the crane of FIG. 1;

FIGS. 5*a*-5*e* show a side view on part of the extendable boom of FIG. 1, illustrating a method operating said extendable crane boom;

FIG. 6*a* shows a side view of a crane arrangement according to another embodiment of the invention comprising an extendable boom with a telescopic boom section in a retracted position;

FIG. 6*b* shows the crane arrangement of FIG. 6*a* with the telescopic boom section in an extended position;

FIG. 9 show a side view of a locking system illustrating the sequence of steps required to lock the telescopic boom section of the crane arrangement of FIG. 6 in an extended position, with:

Figure 9C:
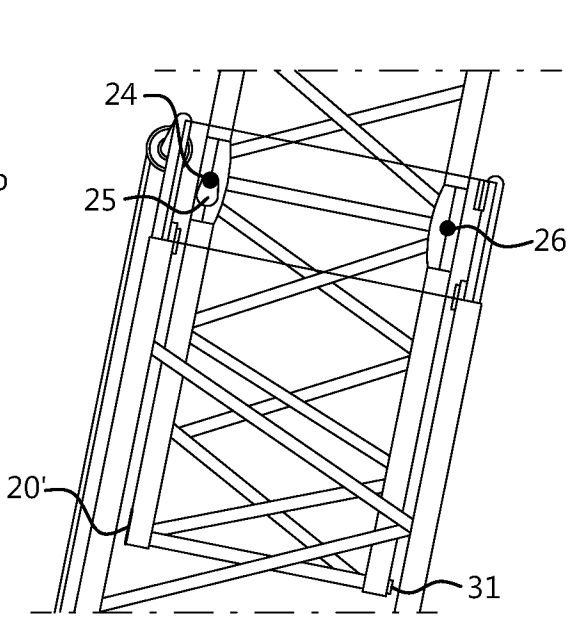
Figure 9B:
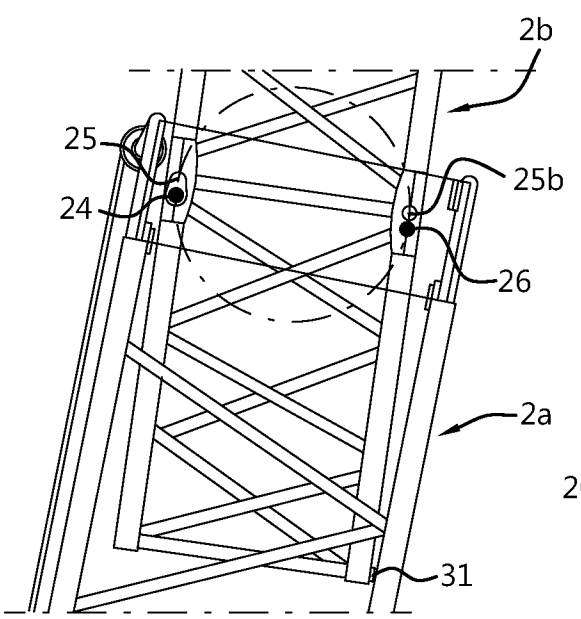
Figure 9A:
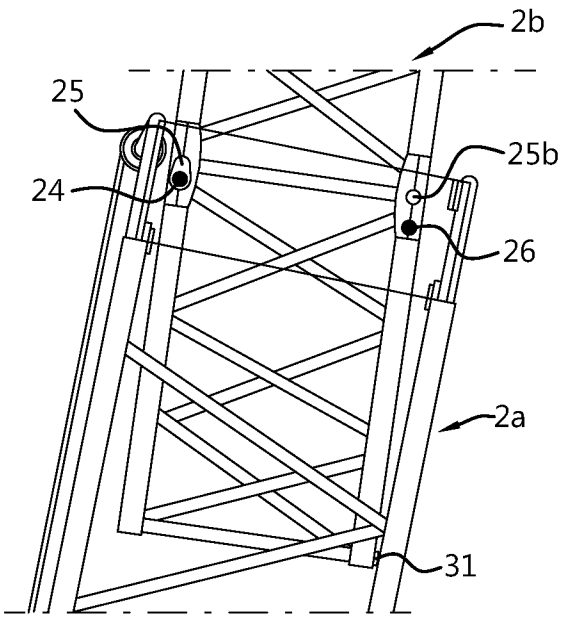
Figure 10:
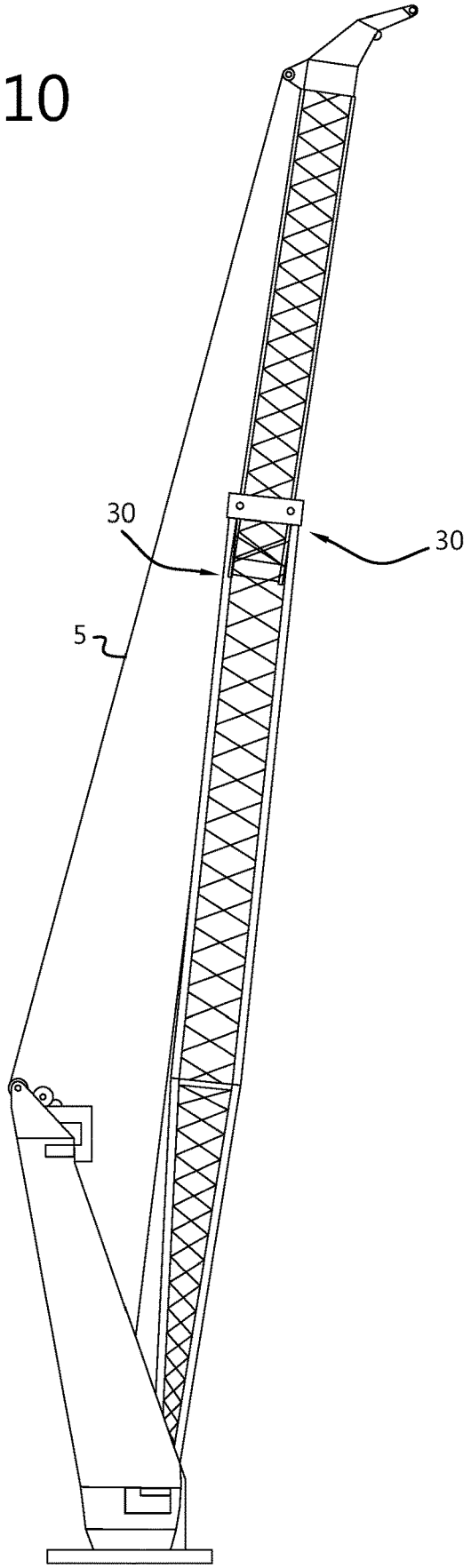
Figure 11A:
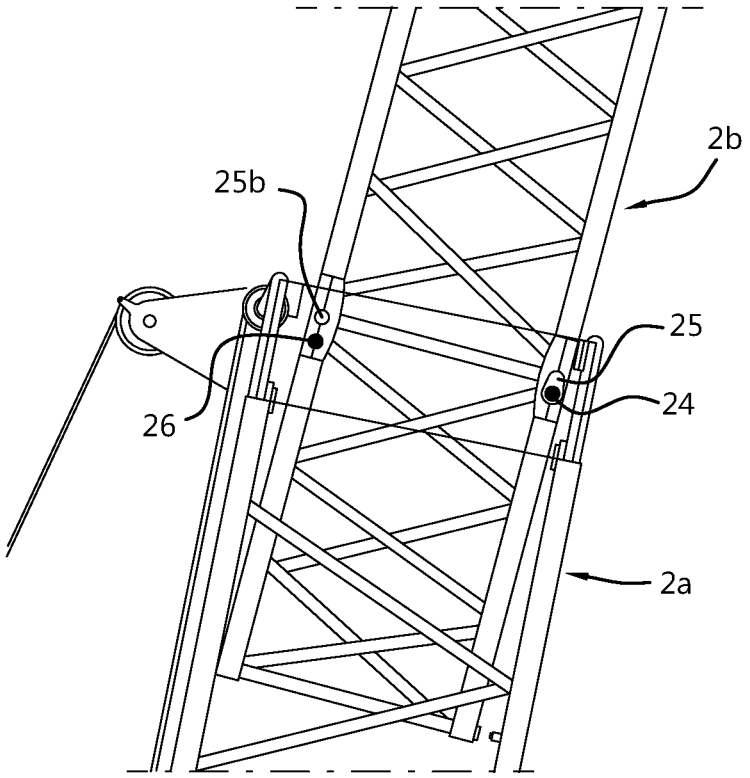

FIG. 9*a* showing step 1: Insertion of the upper pin;

FIG. 9*b* showing Step 2: Alignment of the telescopic part;

FIG. 9*c* showing Step 3: Insertion of the lower pin;

FIG. 10 shows a third embodiment of a crane arrangement comprising an extendable boom with a telescopic part in extended position and the boom hoist wires connected to the pivoting part of the extendable boom;

FIG. 11 show a side view of a locking system illustrating the sequence of steps required to lock the telescopic boom section of the crane arrangement of FIG. 10 in an extended position, with:

FIG. 11*a* Step 1: Insertion of the lower pin

Figure 11B:
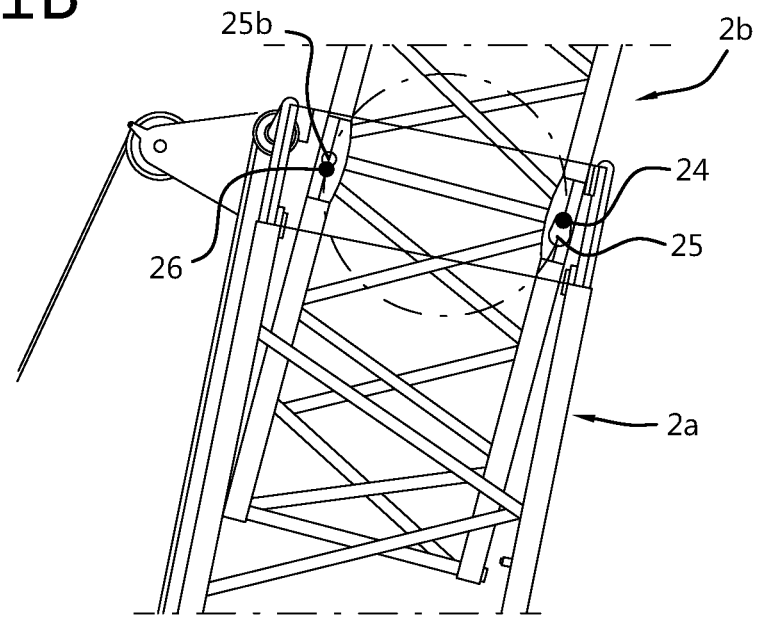

FIG. 11*b* Step 2: Alignment of the telescopic part

Figure 11C:
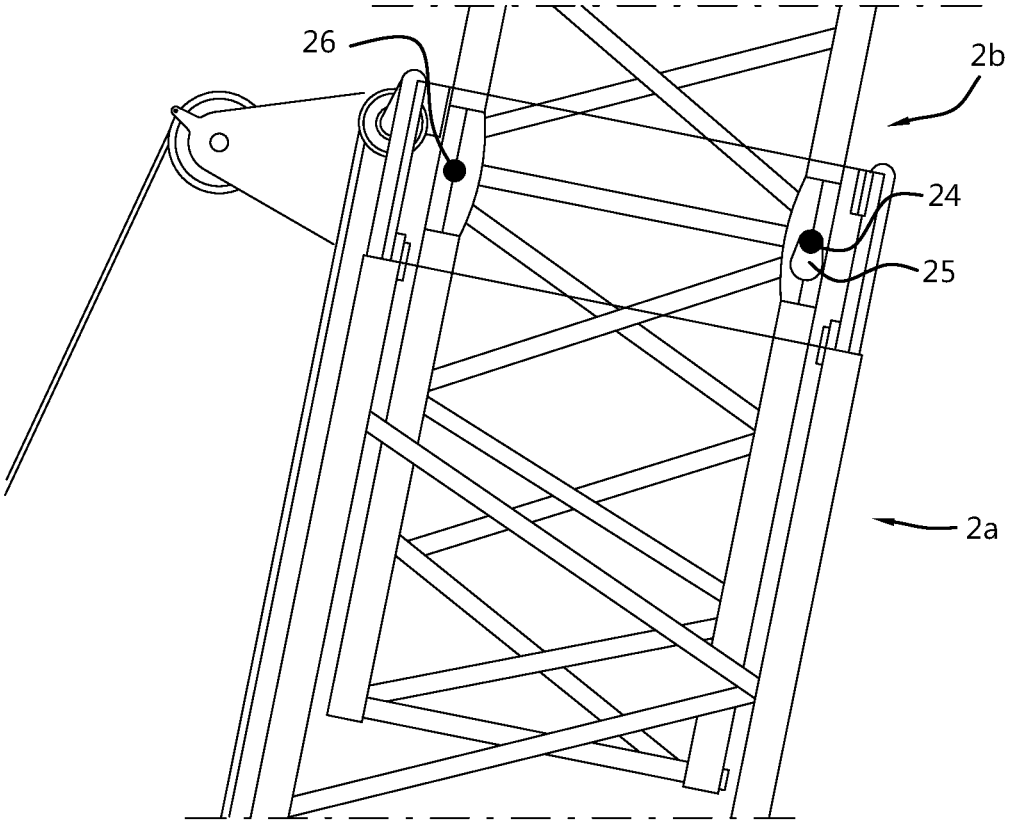

FIG. 11*c* Step 3: Insertion of the upper pin

Figure 12:
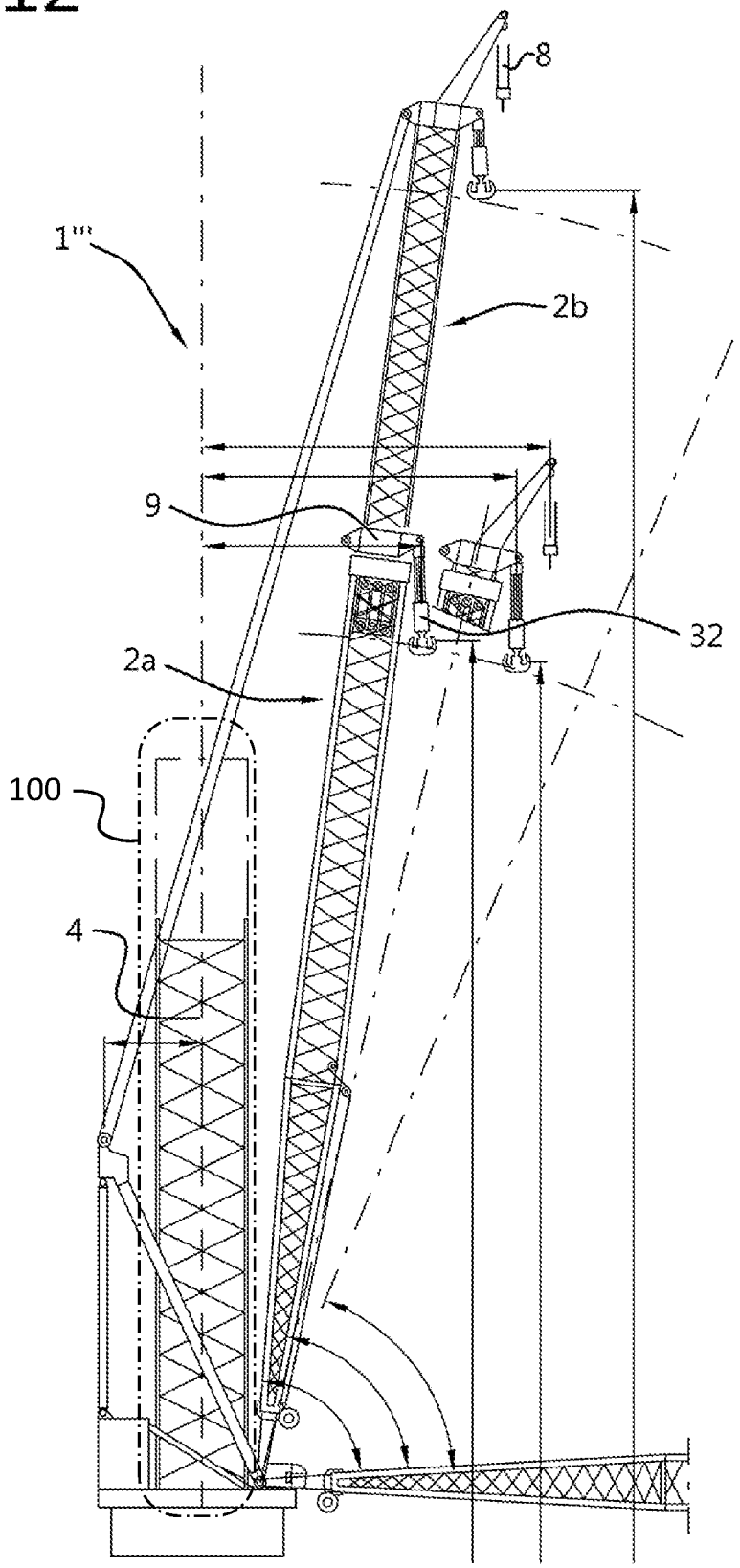

FIG. 12 shows a fourth embodiment of a crane arrangement with the main hoist at the top of the pivoting part of the extendable boom integrated with the locking-pin box structure, and an auxiliary hoist at the boom tip.

Figure 1A:
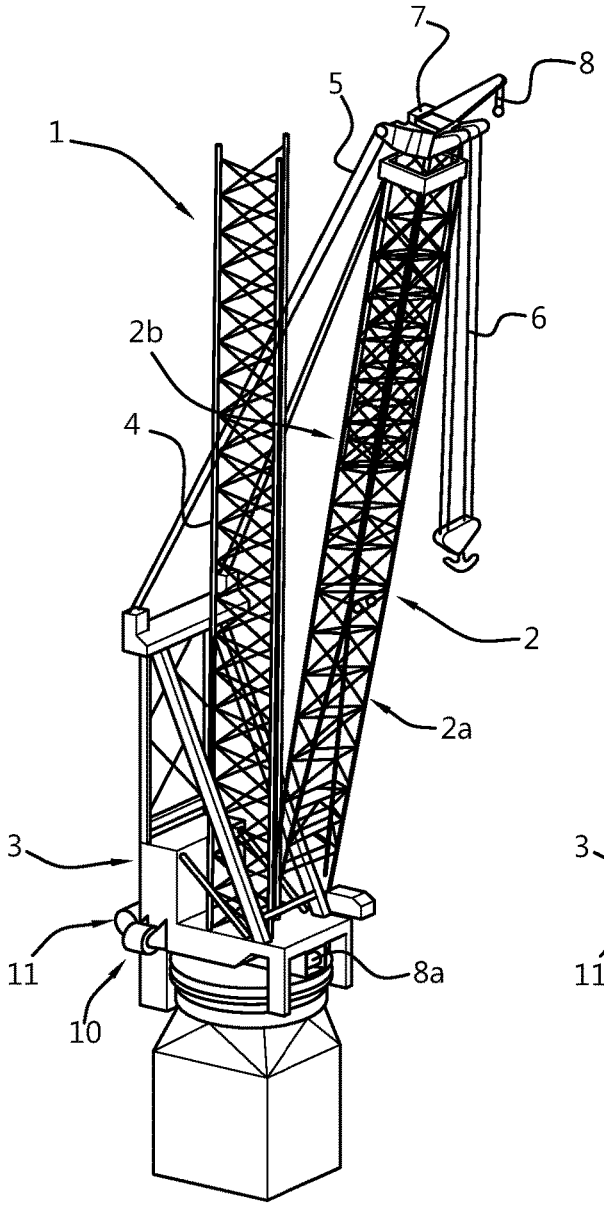
Figure 1B:
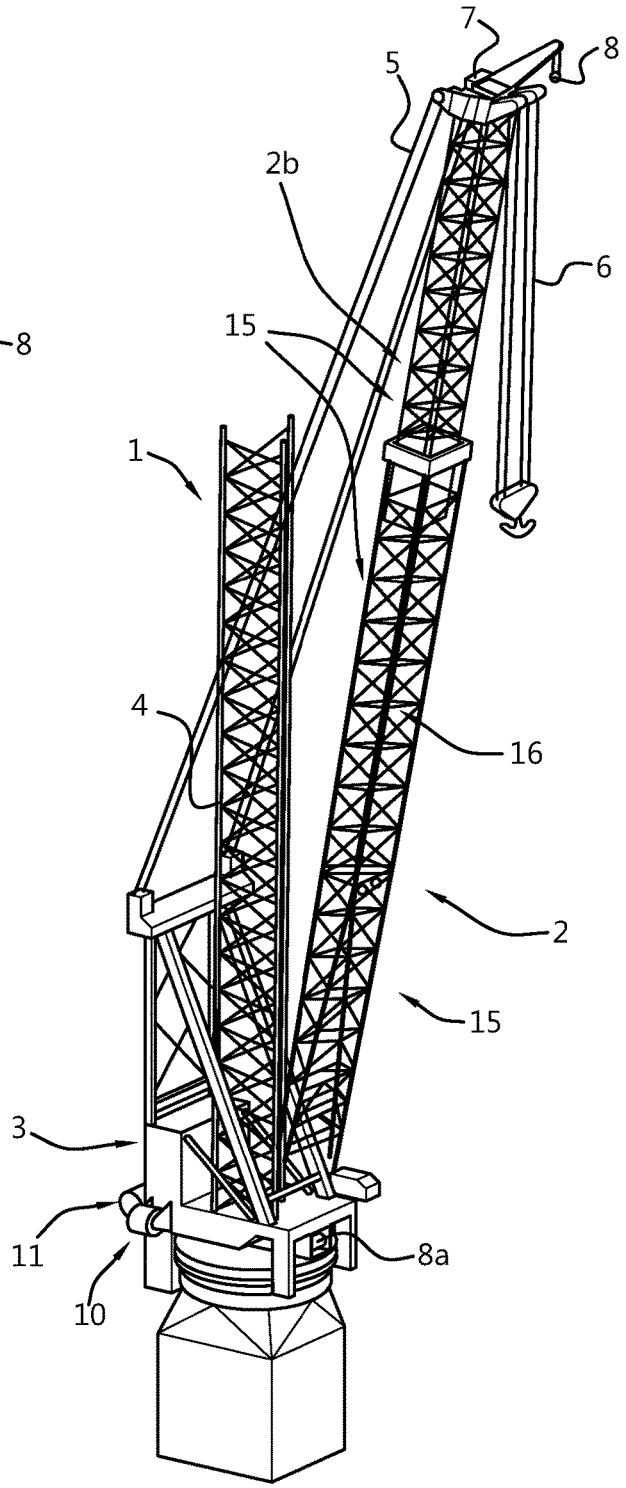

FIGS. 1*a* and 1*b* show a perspective view on a crane 1 including an extendable crane boom 2 according to an embodiment of the invention in a retracted and an extended position respectively. The crane 1 comprises a crane base 3 to which said extendable lattice type boom 2 is rotatably connected. The crane base 3 may be mounted around a leg 4 of a jack up platform, but may also be mounted differently, for example on a standard pedestal with slewing bearing, on a jack up platform or on any other structure where this type of crane is needed. The crane base 3 may be configured such as to be mounted around a leg 4 of a jack up platform. The lattice type boom 2 is movable between a transit position (not shown), in which said lattice type boom 2 is in a substantially retracted and substantially horizontal position, and a working position, in which the lattice type boom is extendable. To perform said movement of the crane boom, the crane 1 also includes a boom hoisting system 5 arranged to move the extendable boom 2 between said transit position and said working position. Said boom hoisting system includes at least one, preferably two, boom hoist winches 11 mounted on the crane base. The boom hoisting system 5 may include two parallel wire rope and sheaves systems both connected to a distal end of the extendable boom, and/or to a distal end of the base boom section 2*a*. The crane 1 is further equipped with a load hoisting system 6 configured to hoist a load. Said load hoisting system 6 may include at least one main hoist winch 10, a head assembly 7 mounted on a distal end of the extendable crane boom 2, as well as an optional secondary hoisting system 8 including an auxiliary hoist winch, which may be configured to hoist smaller loads, to a greater height and more quickly than the main load hoisting system. The main hoisting system may for example be configured to hoist loads of up to approximately 2500 tons to a height of approximately 115 m above ground/deck, or a load of up to approximately 1250 tons to a height of approximately 156 m above ground/deck. Such a configuration allows installation of off-shore wind turbines of up to approximately 16 MW. It is understood that this is just an example, and that smaller or larger configurations are possible. The extendable boom 2 comprises a lattice type base boom section 2*a* and at least one lattice type telescopic boom section 2*b*. The lattice type base boom section 2*a*, as well as the lattice type telescopic boom section 2*b*, each include longitudinal chords 15, in particular four chords 15, at each corner of the boom section 2*a*, 2*b*, which are interconnected with trusses 16. A diameter of the chords 15*a* of the base boom section 2*a* is typically larger than a diameter of the chords 15*b* of the telescopic boom section 2*b*. The telescopic boom section 2*b* is adjustable with respect to the base boom section 2*a* between a retracted position (FIG. 1*a*), in which the telescopic boom section 2*b* is substantially inside of the base boom section 2*a*, and an extended position (FIG. 1*b*), in which the telescopic boom section 2*b* is at least partly outside of the base boom section 2*a*. In the above-mentioned example of a hoisting system configured for hoisting loads up to 2500 tons, the total boom length may for example be around 95 m in a retracted position, whereas the total boom length in a most extended position may for example be as long as approximately 135 m, or longer or shorter.

Figure 2A:
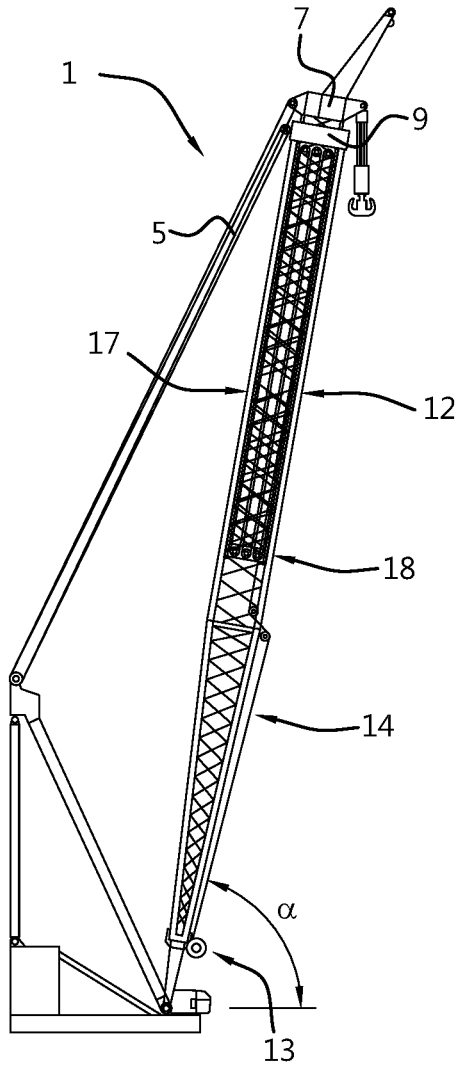
Figure 2B:
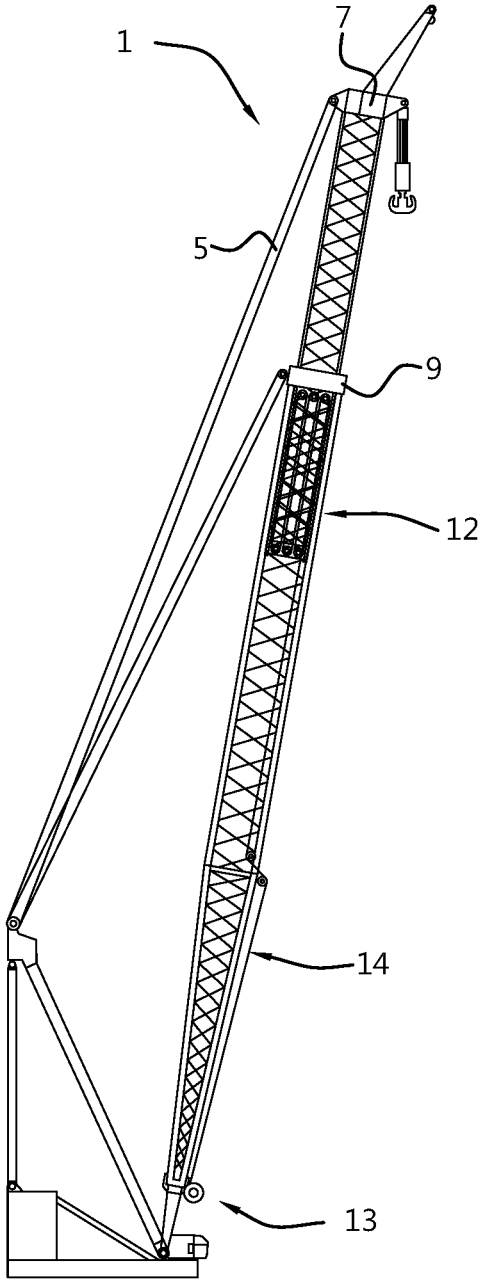

FIGS. 2*a* and 2*b* show a side view on the crane of FIG. 1 in a retracted and an extended position respectively. The boom hoisting system 5 is connected to a distal end of the base boom section 2*a* as well as to a distal end of the telescopic boom section 2*b*, more in particular, to the head assembly 7 on the telescopic boom section 2*b* and to a support structure 9 on a distal end of the base boom section 2*a*. In a working position, as shown, when the extendable boom 2 can be extended, the crane boom 2 makes an angle $\alpha$ with a substantially horizontal transit position of the crane boom 2 in a range of approximately 75°-85°, preferably an angle of approximately 80° with a tolerance of approximately 2°. Said position allows to decrease as much as possible loads on a guiding system (see FIG. 3) of the extendable boom 2. The transit and working positions also allow to define an upper side 17 and a lower side 18 of the extendable boom 2, the lower side 18 being the side of the extendable boom 2 turned downwards in a transit position, and the upper side 17 of the extendable boom 2 being the opposite side of the lower side 18. The boom hoisting system 5 is at least partly mounted on the upper side 17 of the extendable boom 2, whereas loads are hoisted along the lower side 18 of the extendable boom 2. The extendable crane boom 2 also comprises a telescopic system 12 arranged to adjust the at least one telescopic boom section 2*b* between said retracted position and said extended position. Said telescopic system 12 comprises at least one reeving system, preferably two reeving systems, each provided on an opposite side of the base boom section 2*a*, preferably on lateral sides of the base boom section 2*a* (see FIG. 4). The telescopic system 12 can be configured to extend the extendable boom 2 from a retracted position (FIG. 2*a*) to an extended position (FIG. 2*b*) in relatively swiftly. The telescopic system 12 also includes at least one telescopic winch 13. The reeving system may be configured such that pulling a wire rope 14 in with the winch 13 can for example result in the telescopic boom section 2*b* being pulled out of the base boom section 2*a*, thus extending the boom, while moving along a guiding system. During retraction of a telescopic boom section 2*b*, the winch 13 can be operated to release the wire rope 14 allowing the telescopic boom section to move inside of the base boom section, typically moving down as a result of gravity.

Figure 3A:
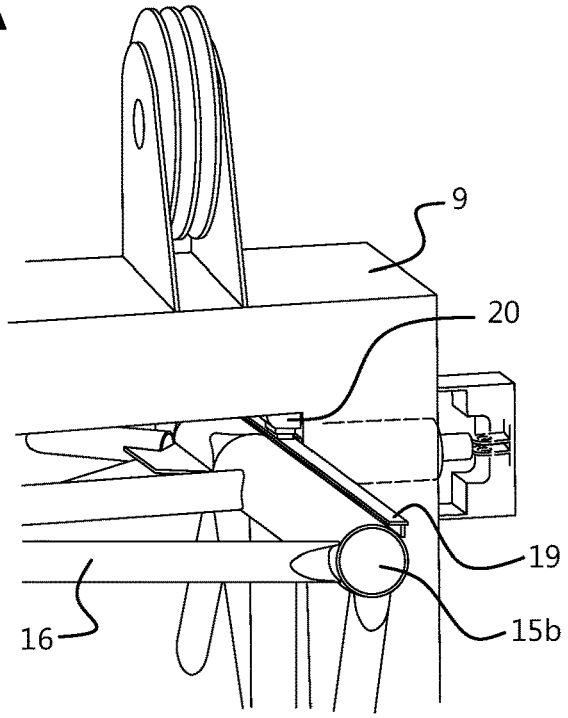
Figure 3B:
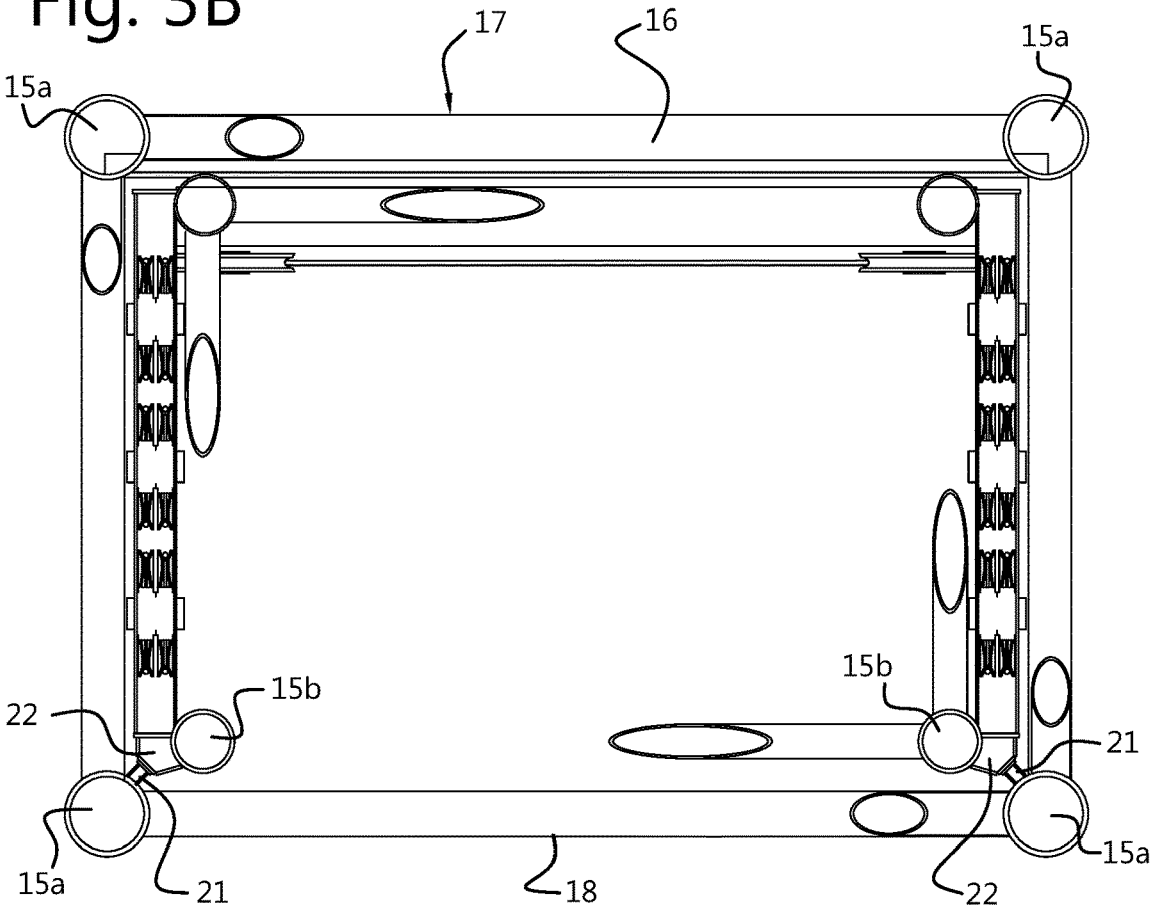

FIG. 3*a* shows a perspective view on an upper side of a telescopic boom section 2*b* of the extendable boom 2 in the crane 1 of FIG. 1, whereas FIG. 3*b* shows a cross-sectional view of a base boom section 2*a* and a telescopic boom section 2*b* of the extendable boom 2 in the crane 1 of FIG. 1. In order to improve a smooth extension and/or retraction of the telescopic boom section 2*b* in and out the base boom section 2*a*, the extendable boom comprises a guiding system including guide rails and guiding elements configured to be guided along the guide rails. The telescopic boom section 2*b* can for example be provided with at least one upper guide rail 19, which is preferably positioned on a chord 15*b* on an upper side 17 of the telescopic boom section 2*b*, more preferably on each of the two chords 15*b* on the upper side 17 of the telescopic boom section 2*b*. The upper guide rails 19 are preferably positioned making an angle with the upper side 17 of the extendable boom 2 of approximately 45°. The upper guiding element 20 configured to be guided on the upper guide rails 19 may for example be a sliding pad mounted on the base boom section 2*a*, preferably on a distal end of the base boom section 2*a*, for example on a support structure 9 on the distal end of the base boom section 2*a*. The upper guiding element 20 may be configured to engage the guide rail 19 on an upper surface of the guide rail 19, which upper surface is substantially in parallel with an upper side 17 of the extendable boom 2. The upper guide rail 19 may be configured to be engaged by a secondary upper guiding element (not shown) along a side of the upper surface of the guide rail 19, which side is at a substantially right angle with said upper surface. The base boom section 2*a* is further provided with at least one lower guide rail 21, preferably with two lower guide rails 21, each provided on a chord 15*a* on the lower side 18 of the extendable boom 2, preferably radially extending inwardly making an angle of 45° with said lower side 18. Lower guiding elements 22 configured to be guided on the lower guide rails 21 may for example be a sliding pad mounted on the telescopic boom section 2*b*, preferably radially extending on a proximal end of the chords 15*b* on a lower side 18 of the telescopic boom section 2*b*. The lower guiding elements 22 engage the lower guide rails 21 on an engagement surface of the guide rail 21, which surface is tilted under an angle of approximately 45° with the lower side of the extendable boom 2, providing a lower radial guiding engagement in contrast to an upper angles guiding engagement. In summary, the base boom section 2*a* is provided with lower guide rails 21 and upper guiding elements 20, whereas the telescopic boom section 2*b* is provided with upper guide rails 19 and lower guiding elements 22. It will be clear to the person skilled in the art that an opposite installation of the guiding system, or a different guiding system, is possible as well. All guide rails 19, 21 can for example be made of steel, preferably greased steel. The upper and lower guide rails 19, 21 can for example extend over a length of approximately 45-50 m along the chords of the telescopic boom section 2*b* or the base boom section 2*a* respectively, depending on a total length of the extendable boom and on a length of the telescopic boom section.

Figure 4:
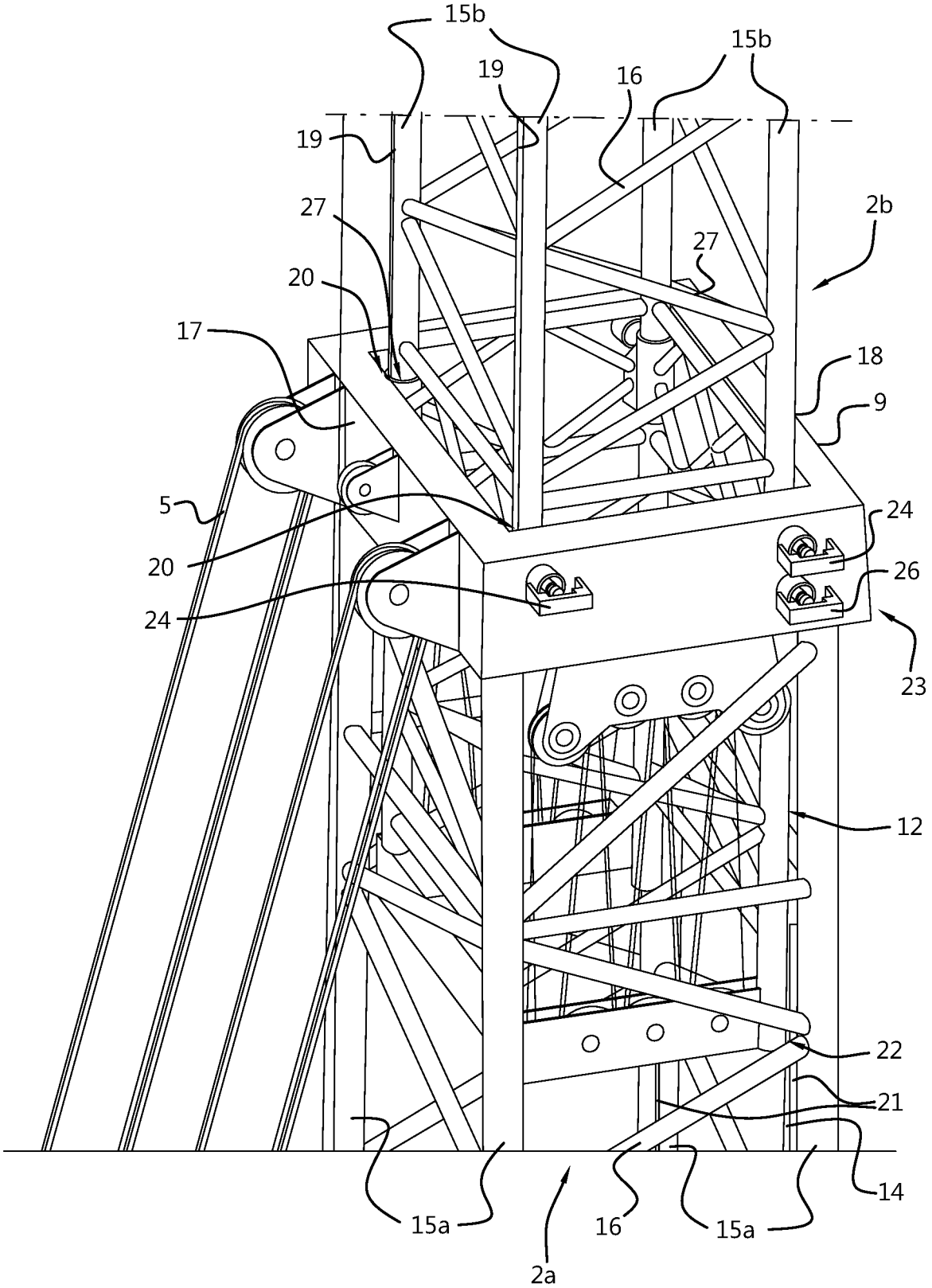

FIG. 4 shows a perspective view on part of the extendable boom in an extended position of the crane of FIG. 1. The extendable boom 2 further comprises a locking system 23 configured to lock the at least one telescopic boom section 2*b* with respect to the base boom section 2*a* in at least an extended position. Said locking system 23 includes a plurality of pins 24, each pin 24 being configured to extend, in at least the extended position of the boom, at least partly through a corresponding pin receiving aperture 25 provided in one of the base boom section 2*a* and the at least one telescopic boom section 2*b*. A size of at least one of said pin receiving apertures 25 is substantially larger than a cross-sectional dimension of a corresponding one of said plurality of pins 24 for engaging in the pin receiving aperture 25. In the embodiment shown in FIG. 4, the locking system 23 comprises a support structure 9 from which the plurality of pins 24 extend. Said support structure 9 is provided at a distal end of the base boom section 2*a*. The corresponding pin receiving apertures 25 are provided at a chord 15*b* of the telescopic boom section 2*b*, in particular at a proximal end of the telescopic boom section 2*b*, more in particular of every chord 15*b* of the telescopic boom section 2*b*. The locking system of the embodiment of FIG. 4 includes four primary pins, each extending into a corresponding aperture 25 in the telescopic boom section 2*b*. The locking system 23 also comprises a secondary set of pins 26 and corresponding pin receiving apertures, which are provided in the chords 15*b* on the lower side 18 of the extendable boom 2. Preferably at least one of the pin receiving apertures has a size which is substantially larger than a cross-sectional dimension of the corresponding pin to be received. The pins 24 are applied to obtain a direct connection between the chords 15*b* of the telescopic boom section 2*b* and the chords 15*a* of the base boom section 2*a*. The telescopic boom section 2*b* can include a locally forged or welded structure 27 at the location of the pin receiving apertures 25.

Figure 5B:
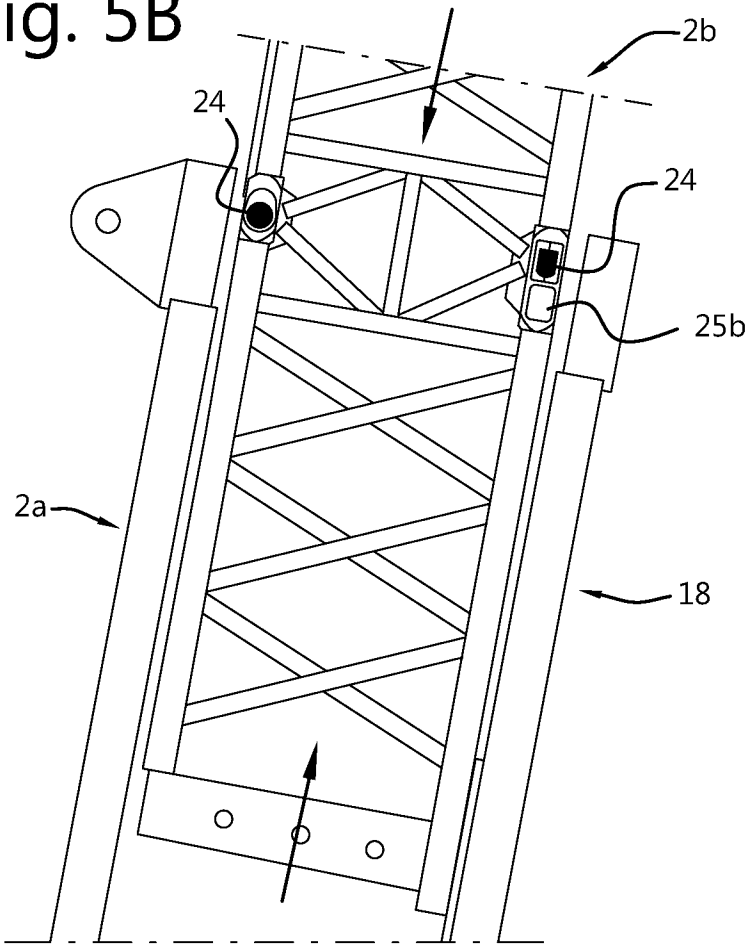
Figure 5A:
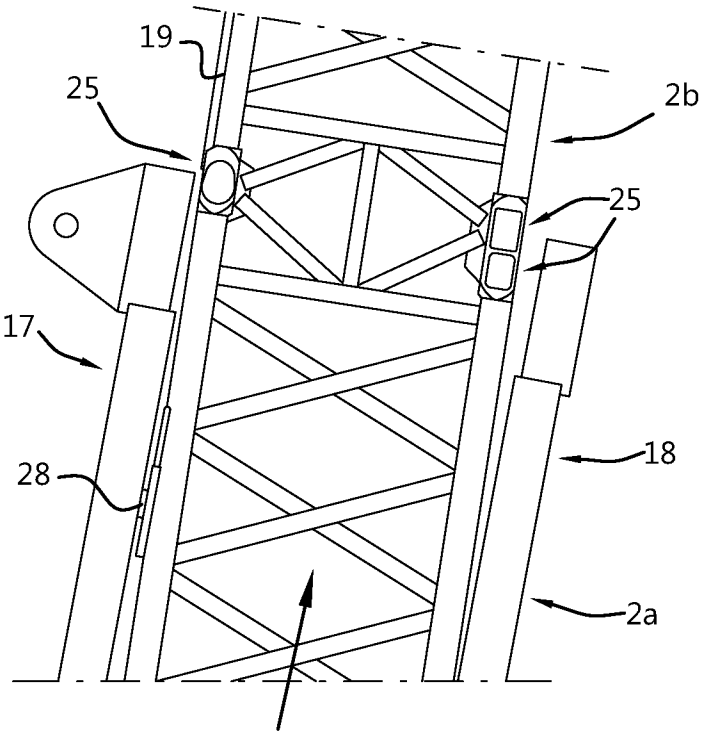
Figure 5C:
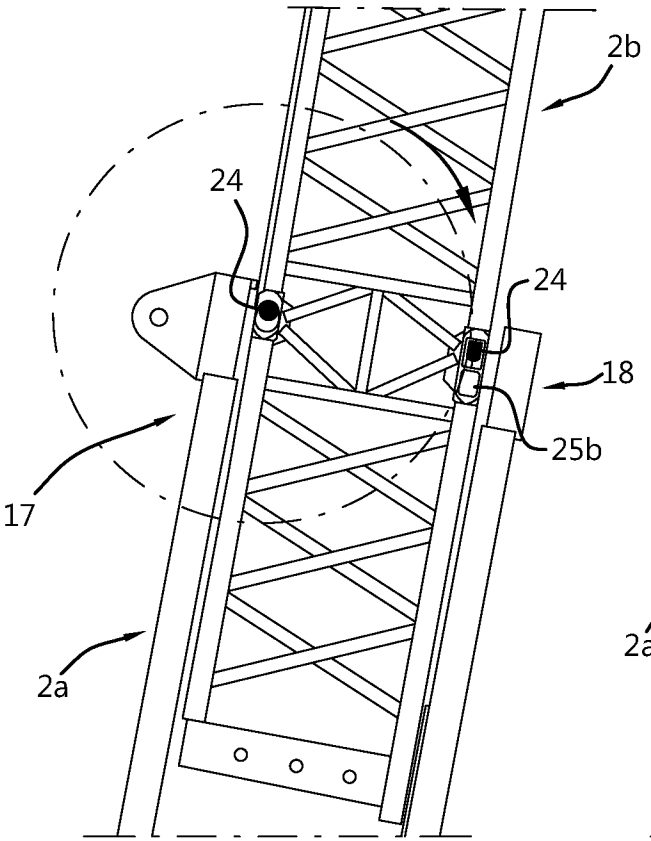
Figure 5D:
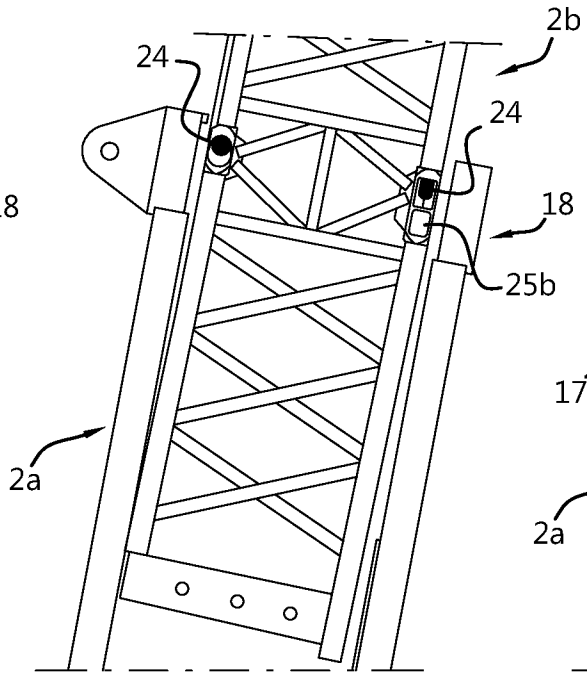
Figure 5E:
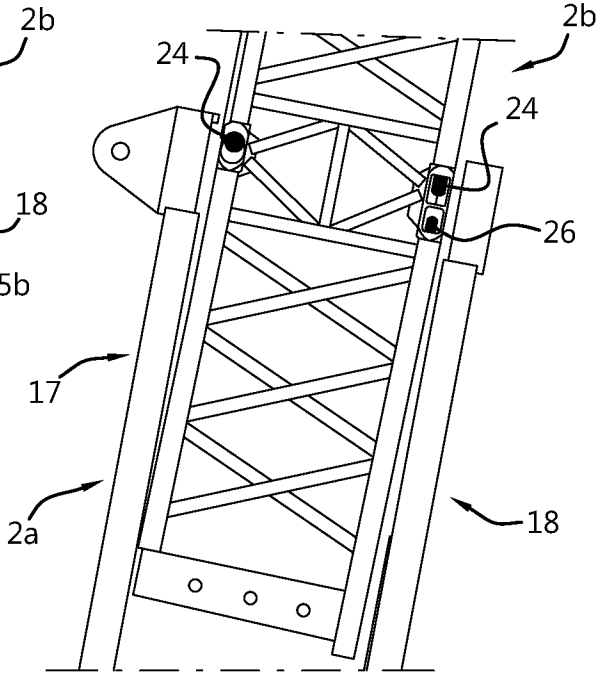

FIGS. 5*a*-5*e* show a side view on part of the extendable boom 2 of FIG. 1, illustrating a method of operating said crane 1. The method comprises a first step (not shown) of operating a boom hoisting system 5 to bring the extendable lattice type boom 2 from a transit position to a working position, so from a substantially horizontal and retracted position to a position in which the extendable crane boom 2 includes a crane boom angle of approximately 80° with the substantially horizontal transit position. As a next step, illustrated in FIG. 5*a*, a telescopic system 12 is operated to adjust the telescopic boom section 2*b* with respect to the base boom section 2*a* from a retracted position, in which the telescopic boom section 2*b* is substantially inside of the base boom section 2*a*, to an extended position, in which the telescopic boom section 2*b* is substantially outside of the base boom section 2*a*. During operation of the telescopic system 12 to extend or retract the telescopic boom section 2*b* with respect to the base boom section 2*a*, the boom hoist system 5 may be operated to facilitate the movement of the telescopic boom section 2*b*. An separate alignment system is not needed in this embodiment. During operation of the telescopic system 12, a measurement system 28 can determine an actual position of the telescopic crane boom section 2*b* with respect to the base boom section 2*a*. The measurement system can provide output of a determined actual position to an output module, which can for example automatically control the telescopic system. Upon approaching a desired extended position, i.e. a locking position in which the pins 24 are facing the corresponding pin receiving apertures 25, the measurement system 28 may control a speed reduction of the telescopic system 12, for example a speed reduction to approximately 10% of the previous speed, so for example to a speed of 5 mm per second from 0.5 m before said locking position. The telescopic system 12 may be configured to stop automatically when the telescopic boom section 2*b* reaches the desired locking position. The exact position of the telescopic boom section 2*b* can then be checked again, for example visually by an operator using for example a closed circuit TV system. The operator can then give a signal for pin insertion, which is the next step of the method, as illustrated in FIG. 5*b*. At least one, but preferably all four primary pins 24, are inserted through a corresponding pin receiving aperture 25 to substantially determine a position of the telescopic boom section 2*b* with respect to the base boom section 2*a*. The pins can for example be hydraulically actuated, or actuated in any other known way. As can be seen in FIG. 5*b*, the pin receiving apertures 25 are substantially larger than a cross-sectional dimension of a corresponding one of said plurality of pins 24 for engaging in the pin receiving aperture 25, i.e. the space around the pins 24 during insertion into the apertures 25 is at least 10 mm, and preferably a lot more in a longitudinal direction of the chords, so that insertion can be done freely and the pins 24 cannot get stuck. The primary pins 24 to be inserted into a corresponding aperture in a chord 15*b* on the upper side 17 of the extendable boom 2 are preferably pins having a substantially round cross-section, whereas the pins to be inserted into a corresponding aperture in a chord 15*b* on the lower side 18 of the extendable boom 2 are preferably pins having a substantially rectangular cross-section. The pin receiving apertures 25 may for example also be droplet-shaped. In a next step, illustrated in FIG. 5*c*, an angular position of the telescopic boom section 2*b* with respect to the base boom section 2*a* is adapted until a secondary pin receiving aperture 25*b* corresponds with a secondary pin 26. The secondary pin receiving aperture 25*b* may be separated from the primary pin receiving aperture 25, as illustrated here, but may also be part of a larger single pin receiving aperture, of which an upper section is configured to receive a primary pin 24 and a lower section is configured to receive a secondary pin 26. This adapting of an angular position can be done by operating the telescopic system 12, lowering the telescopic boom section 2*b* until the primary pins 24 on the upper side 17 of the boom 2 make contact with an edge of the corresponding pin receiving aperture 25. The guiding system, in particular the upper guide rail 19, on the upper side 17 of the boom 2 is now free and load is now transferred through said pins, while the guiding system, in particular the lower guide rails 21, on the lower side 18 of the boom 2 still makes contact and is loaded. As illustrated in FIG. 5*d*, the telescopic boom section 2*b* is then lowered still further until the primary pins 24 on the lower side 18 of the crane boom 2 make contact with an upper edge of the corresponding pin receiving aperture 25. Now both the upper guide rails 19 as well as the lower guide rails 21 are unloaded. The pins 24 on the upper side 17 take shear and axial load, whereas the pins 24 on the lower side 18 of the crane boom 2 only take axial load. Finally, at least one, and preferably two secondary pins 26 are inserted into corresponding pin receiving apertures, preferably only on the lower side 18 of the crane boom 2. The secondary pins 26 make contact with a lower edge of the corresponding pin receiving aperture 25*b*, such as to stably lock the telescopic boom section 2*b* with respect to the base boom section 2*a*.

Figure 6A:
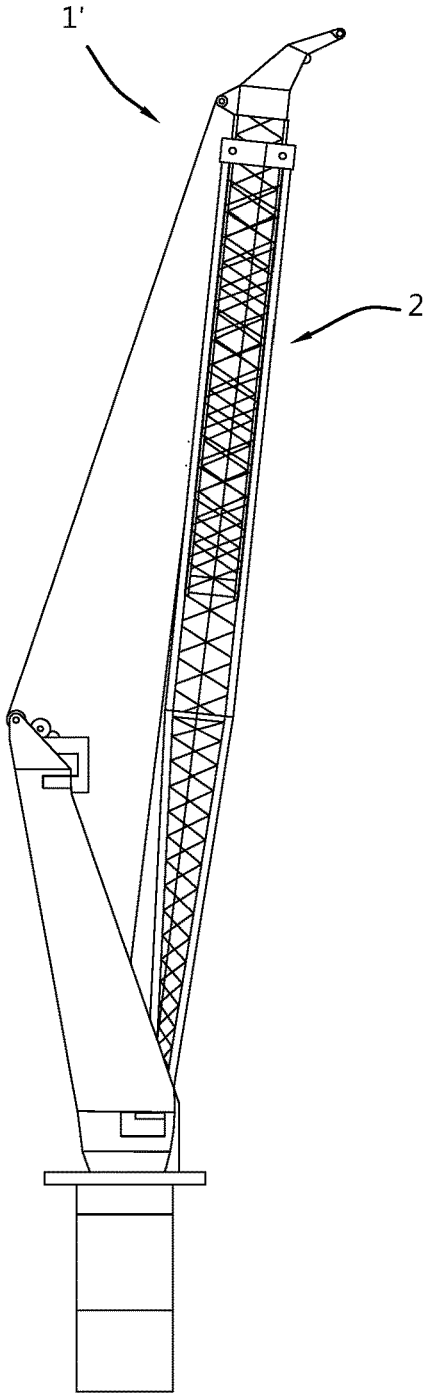
Figure 6B:
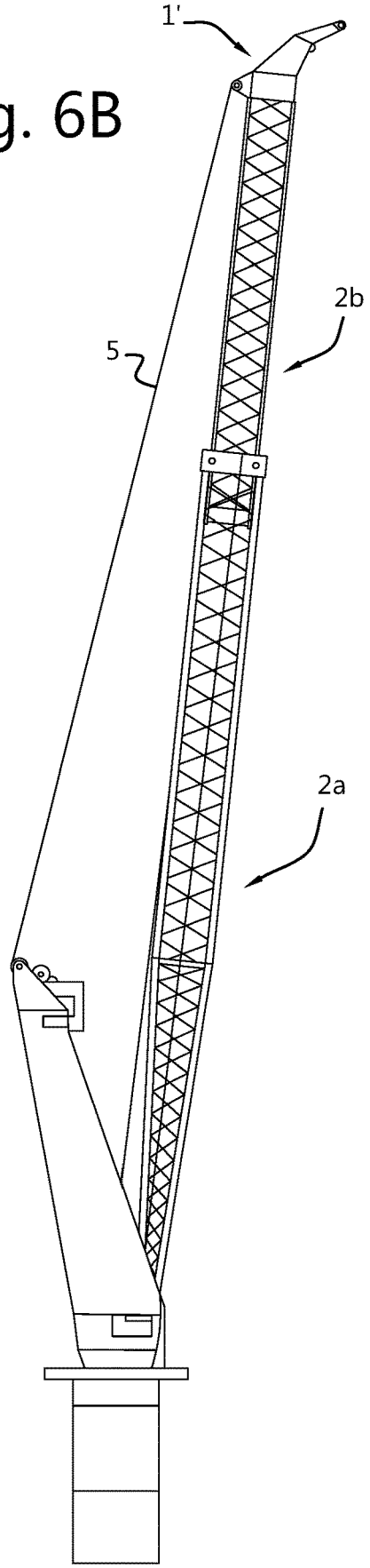

In FIGS. 6*a* and 6*b* a second embodiment of an extendable crane 1' with a base boom section 2*a*, also known as the fixed boom part, and one telescopic boom section 2*b* is presented in the retracted and the extended position respectively. The boom hoist wires or luffing wires of the boom hoisting system 5 are connected to the top of the telescopic part. Note that 'wire' can also mean 'wire rope', 'rope' or 'cable'. The extendable boom is shown as part of a pedestal crane, but this can be any type of crane with boom hoist wires.

The boom 2 is in retracted position when the distal telescopic boom sections 2*b* are stored in the base boom section 2*a*. In the retracted position the boom 2 can be upended by means of the boom hoist system 5. For normal lifting purposes, the crane 1' can be used in the retracted position, as the crane is then stronger (more capacity) and/or more flexible and/or easier to use than with an extended boom 2. In the upended or working position the boom 2 can be extended when large lifting height is required, for example when installing a wind turbine on top of a tower.

Figure 7:
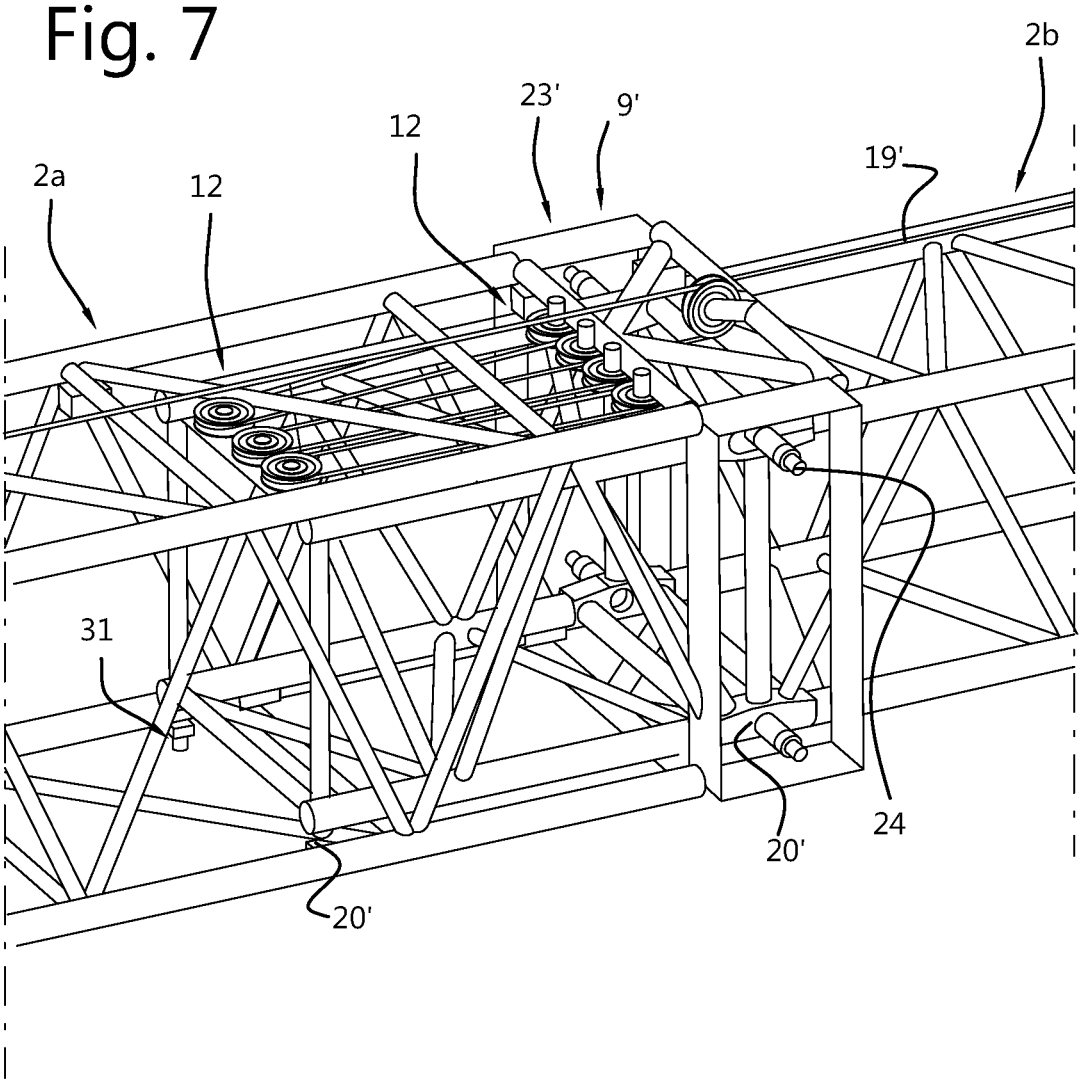
FIG. 7 is a perspective view of a locking system of the crane arrangement of FIG. 6.

FIG. 7 shows a perspective view of the locking system 23'. The lattice structure has in this embodiment a rectangular shape with four chords 15. The chords 15 at the side where boom hoisting elements are provided, are denoted as 'upper chords'. The chords at the opposite side thereof, are denoted as 'lower chords'. The telescopic boom section 2*b* may fit into the base boom section 2*a*. For the telescopic system 12 a multi-falls reeving system is provided that is mounted in between the telescopic boom section 2*b* and the base boom section 2*a*. The hauling part is going to a winch located on the slewing platform.

Guide rails 19' are connected on the chords 15 of the telescopic boom section 2*b*. In the base boom section 2*a* the lower and upper guides 20' are mounted. The guide system can be arranged vice versa as well, for example with the guide rails 19' on the base boom section 2*a* and the guides 20' on the telescopic boom section 2*b*.

The locking system 23' comprises a support structure 9' that is provided in the head of the base boom section 2*a*. The support structure 9' is embodied here as a reinforced 'box-like' structure, of which the sides are provided as plate structure to which the locking pins are mounted. For reasons of simplicity, the side plates are not shown in FIG. 7. The box structure has additional reinforcements to transfer the load of the locking pins locally. The support structure 9' is designed in such a way that the pin load, when the boom is in extended and locked position, does not lead to additional moments in the chords of the fixed part. So the chords of the fixed part are advantageously only loaded in compression (or tension).

Figure 8:
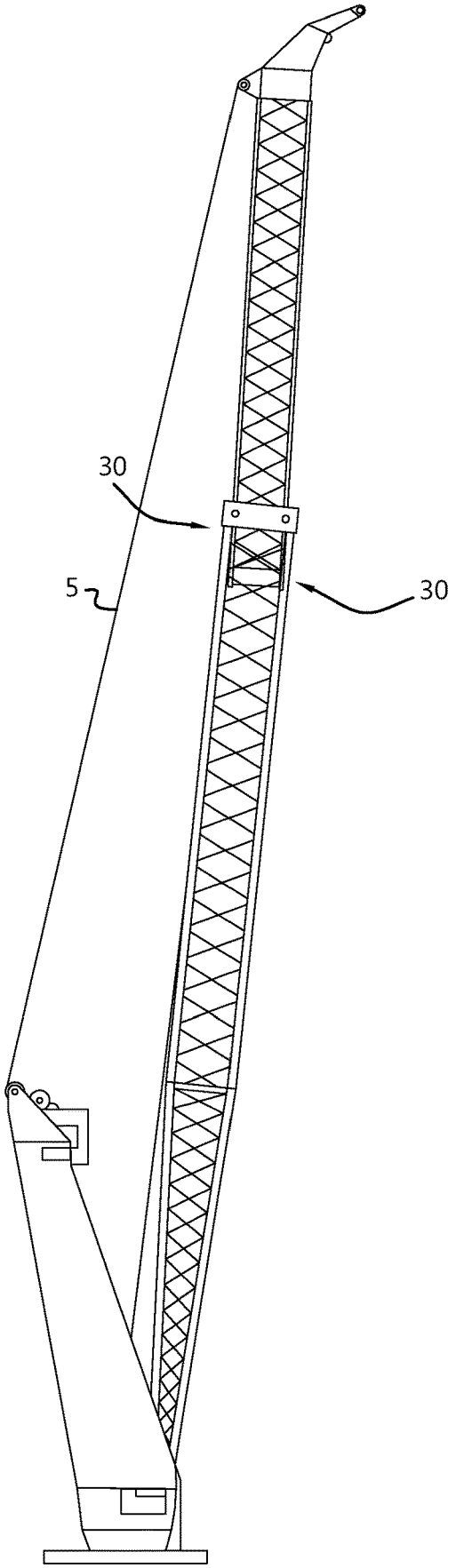
FIG. 8 shows a side view of the crane arrangement of FIG. 6*a* with the guiding contacts during extension or retraction.

In FIG. 8 an extendable boom crane 1' with luffing wires (boom hoist wires) of the boom hoist system 5 connected to the telescopic boom section 2*b* of the boom 2 is shown. The locations where the telescopic guides have contact are indicated by arrows 30. This is the situation when the boom 2 is fully extended and with no load in the hook. Because of the own weight of the boom and the position of the luffing wires the boom is subject to a bending moment and slightly bends downwards. In FIG. 8 the bending of the boom is exaggerated. In practice there is only a relatively small play between the guiding of the base boom section 2*a* and the telescopic boom section 2*b*. Basically the upper chords 15 are likely to remain under compression. Thereto a slotted-hole connection can be applied for easy insertion of the locking pin 24 in the upper chord 15, as shown in FIG. 9*a*. After alignment of the telescopic boom section 2*b* with respect to the base boom section 2*a*, the locking pin 26 can also be inserted into the aperture 25*b* of the lower chord, which preferably is a fitting aperture. Since the lower chords can be loaded under tension, as well as under compression, with load in the hook, the locking pin connection at the lower chord is preferably a fitting connection, contrary to the slotted connection of the upper chord.

The procedure for operating the extendable boom with boom hoist wires connected to the boom top is shown in FIGS. 9*a*-9*c*.

Step 1: With the winch of the telescopic system the telescopic boom section 2*b* can be extended. The telescopic boom section 2*b* can be extended a little bit "too" far. The upper pin 24 can be easily inserted in the slotted hole 25. The own weight bending moment in the boom can still be transferred by the guiding system. After the upper pin insertion the telescopic system 12 can lower the telescopic boom section 2*b* a little bit until the upper pin 24 is in contact with the corresponding slotted aperture 25 of the telescopic boom section 2*b*. The telescopic system 12 does not need to be actuated anymore, and the actuator can be decoupled and/or unloaded from the telescopic system, so the telescopic system does not transfer load in the extended position. The slotted hole dimensions will be designed in such a way that it can take over the compression load but it also allow alignment of the telescopic boom section and can unload the upper guides, after alignment.

Step 2: With the hydraulic jacks 31 of the alignment system the telescopic boom section 2*b* can be rotated over a small angle with respect to the upper pin connection to undo the contact of the lower guide 20' from its corresponding guide rail 19'. The telescopic boom section 2*b* can now be accurately aligned with the base boom section 2*a*. When both the telescopic boom section 2*b* and the base boom section 2*a* are in line, the locking pin 26 and aperture 25*b* of the lower part will be in line as well and the lower pin 26 can be inserted.

Step 3: The final step can be to insert the lower locking pin 26 and to release the hydraulic jacks 31 of the alignment system. All the guides 20' are retrieved now and not in load transferring contact anymore with the respective guide rail. The boom loads can be transferred through the locking pins. When the locking pins are engaged the winch of the telescopic system may be unloaded to be sure that all the load transfer is via these locking pins.

In FIG. 10 an extendable boom crane 1" with luffing wires (boom hoist wires) of a boom hoist system 5 connected to the base boom section 2*a* is shown. The locations where the telescopic guides have contact are again indicated by arrows 30. The loads act in the opposite direction when compared to the situation shown in FIG. 8. This is the situation when the crane is fully extended and with no load in the hook. Because of the own weight of the boom and the position of the luffing wires the boom is subject to a bending moment and bends upwards. In FIG. 10 the bending of the boom is exaggerated. In practice there is only a relatively small play between the guiding of the base boom section and the telescopic boom section. The load moment in the telescopic boom section is in this case always in the same direction. The upper chords are loaded under tension and the lower chords are loaded under compression. So there is no change of load direction. Both upper and lower holes can therefore be provided as slotted holes. The locking procedure is less critical but the pin load is in this execution much higher because of the additional load moment due to the overturning of the telescopic boom section. A fitting pin and aperture connection is not required but can be applied in the upper chord.

The procedure for operating the extendable boom crane 1" with boom hoist wires (luffing wires) connected to the top of the base boom section is shown in FIGS. 11*a*-11*c*.

Step 1: With the winch of the telescoping system the telescopic boom section 2*b* can be extended. The telescopic boom section 2*b* will be extended a little bit "too" far. The lower pin can 24 be easily inserted in the slotted hole 25. The own weight moment in the boom will still be transferred by the guiding system. After the lower pin insertion the telescopic system 12 may lower the telescopic boom section 2*b* a little bit until the upper pin 24 is in contact with the corresponding aperture 25 of the telescopic boom section 2*b*. The actuator of the telescopic system can be unloaded, so to relieve the telescopic system from load transfer. The slotted hole dimensions are preferably designed in such a way that it can take over the compression load but it also may also allow alignment of the telescopic boom section.

Step 2: With the hydraulic jacks of the alignment system the telescopic boom section 2*b* can be rotated over a small angle with respect to the lower pin connection to undo the load transferring connection between the upper guide and the corresponding guide rail. The telescopic boom section 2*b* can now be accurately aligned with the base boom section 2*a*. When both the telescopic boom section 2*b* and the base boom section 2*a* are in line, the pin 26 and aperture 25*b* of the upper part may be in line as well and the upper pin 26 can be inserted.

Step 3: The final step may be to insert the upper locking pin 26 and to release the hydraulic jacks of the alignment system. All the guides are free from their corresponding guide rail, so load transfer between the guide and the guide rail may be obviated. Preferably, the guide and the guide rail are not in contact anymore. The boom loads may be transferred through the locking pins. When the locking pins are engaged the actuator of the telescopic system can be unloaded as well to ensure that all the load transfer is via these locking pins and not via the telescopic system.

FIG. 12 shows an alternative embodiment of a crane 1'" around a leg 4, such as frequently utilized on an offshore jack up platform 100, with extendable boom 2. The support structure 9 at the top of the base boom section 2*a*, in which the locking pins 24 are mounted, now has an integrated main hoist 32. In normal operation, the telescoping section 2*b* will be retracted and the main hoist 32 at the base boom section 2*a* will be used. When large lifting height is required, such as when a wind turbine is installed on top of a tower, or blades are attached to the wind turbine, the crane 1'" will be extended and the auxiliary hoist 8 will be used.

A crane 1 with extendable boom 2, comprising of lattice type sections, has several advantages when utilized on offshore installation jack-up platforms. The crane boom 2 may be retracted when in transit positions which means that the boom, capable of large lifting height as required for installing wind turbines, may not protrude from the boom rest, which obviates the problems that occur when utilizing a longer fixed boom.

It is to be noted that the figures are only schematic representations of embodiments of the invention that are given by way of non-limiting examples. For the purpose of clarity and a concise description, features are described herein as part of the same or separate embodiments, however, it will be appreciated that the scope of the invention may include embodiments having combinations of all or some of the features described. The word 'comprising' does not exclude the presence of other features or steps than those listed in a claim. Furthermore, the words 'a' and 'an' shall not be construed as limited to 'only one', but instead are used to mean 'at least one', and do not exclude a plurality. The mere fact that certain features are recited does not indicate that a combination of these features cannot be used to an advantage. Many variants will be apparent to the person skilled in the art. All variants are understood to be comprised within the scope of the invention.

The invention claimed is:

1. An extendable lattice type crane boom for a crane, the crane boom comprising a lattice type base boom section and at least one lattice type telescopic boom section, wherein the at least one telescopic boom section is adjustable with respect to the base boom section between a retracted position and an extended position, in which, in the extended position, the telescopic boom section is outside of the base boom section to a greater extent than in the retracted position, further comprising a locking system configured to lock the at least one telescopic boom section with respect to the base boom section in at least the extended position, wherein said locking system includes a plurality of pins that include at least one primary pin configured to extend, in at least the extended position of the boom, at least partly through a corresponding primary pin receiving aperture provided in one of the base boom section and the at least one telescopic boom section, wherein the primary pin can be received at a wider part of the corresponding primary pin receiving aperture and then, to provide further locking, can move to a narrower part of the corresponding primary pin receiving aperture to align and lock the primary pin in the corresponding primary pin receiving aperture, wherein the wider part of said corresponding primary pin receiving aperture is larger than a cross-sectional dimension of said primary pin for engaging said primary pin in said corresponding primary pin receiving aperture and allowing movement of said primary pin in said corresponding primary pin receiving aperture, wherein the plurality of pins further include at least one secondary pin configured to extend at least partly through a corresponding secondary pin receiving aperture, wherein the secondary pin can be received in the corresponding secondary pin receiving aperture only after the at least one primary pin has moved to the narrower part of the corresponding primary pin receiving aperture.

2. The extendable lattice type crane boom according to claim 1, wherein said locking system comprises a support structure from which the plurality of pins extend.

3. The extendable lattice type crane boom according to claim 2, wherein said support structure is provided at a distal end of the base boom section.

4. The extendable lattice type crane boom according to claim 1, wherein the corresponding primary pin receiving aperture is provided at a chord of the telescopic boom section.

5. The extendable lattice type crane boom according to claim 4, wherein the chord is at a proximal end of the telescopic boom section.

6. The extendable lattice type crane boom according to claim 4, wherein said at least one primary pin and said corresponding primary pin receiving aperture are a plurality of primary pins and corresponding primary pin receiving apertures, said plurality of primary pins and corresponding primary pin receiving apertures being provided at every chord of the telescopic boom section.

7. The extendable lattice type crane boom according to claim 1, wherein said at least one secondary pin and said corresponding secondary pin receiving aperture are a plurality of secondary pins and corresponding secondary pin receiving apertures, said plurality of secondary pins and corresponding secondary pin receiving apertures being provided at a lower side of the base boom section and of the telescopic boom section.

8. The extendable lattice type crane boom according to claim 1, comprising a guiding system configured to guide a movement of the telescopic boom section along the base boom section, wherein said guiding system is provided on a chord of the base boom section and/or the telescopic boom section under an angle of 45° with respect to an upper or a lower side of the boom.

9. The extendable lattice type crane boom according to claim 1, further comprising a measurement system that detects a position of the telescopic boom section with respect to the base boom section.

10. The extendable lattice type crane boom according to claim 1, further comprising a telescopic system arranged to adjust the at least one telescopic boom section between said retracted position and said extended position, wherein the telescopic system comprises two reeving systems, each provided on an opposite side of the base boom section.

11. The extendable lattice type crane boom according to claim 10, wherein the two reeving systems are provided on opposite, lateral sides of the base boom section.

12. The extendable lattice type crane boom according to claim 1, wherein the at least one telescopic boom section is a plurality of telescopic boom sections, wherein each of said plurality of telescopic boom sections is lockable with a contiguous telescopic boom section via the locking system.

13. A crane comprising the extendable lattice type crane boom according to claim 1, wherein said telescopic boom section is movable between a transit position, in which said telescopic boom section is in the retracted position and substantially horizontal, and a working position, in which the telescopic boom section is in the extended position;

a crane base to which said extendable lattice type crane boom is pivotably connected;

a boom hoisting system arranged to move the telescopic boom section between said transit position and said working position;

a load hoisting system configured to hoist a load.

14. The crane according to claim 13, wherein the boom hoisting system is connected to a distal end of the base boom section as well as to a distal end of the telescopic boom section.

15. The crane according to claim 13, wherein the crane base is mountable around a leg of a jack up platform.

16. A jack up platform including the crane according to claim 13.

17. The extendable lattice type crane boom according to claim 1, wherein the corresponding secondary pin receiving aperture has a size which is larger than a cross-sectional dimension of the at least one secondary pin configured to extend at least partly there through.

18. A method of operating a crane including an extendable lattice type crane boom, wherein the extendable lattice type boom comprises a lattice type base boom section and at least one lattice type telescopic boom section, the method comprising the steps of:

operating a boom hoisting system to bring the extendable lattice type crane boom from a transit position to a working position;

operating a telescopic system to adjust the at least one lattice type telescopic boom section with respect to the lattice type base boom section from a retracted position to an extended position, in which the lattice type telescopic boom section is outside of the lattice type base boom section to a greater extent than in the retracted position;

inserting at least one primary pin least partly through a corresponding primary pin receiving aperture to substantially determine a position of the lattice type telescopic boom section with respect to the lattice type base boom section, wherein a size of the corresponding primary pin receiving aperture is larger than a cross-sectional dimension of the at least one primary pin to allow movement of the primary pin in the corresponding primary pin receiving aperture;

adapting an angular position of the lattice type telescopic boom section with respect to the lattice type base boom section until a secondary pin receiving aperture corresponds with a secondary pin;

inserting the secondary pin in the secondary pin receiving aperture.

19. The method according to claim 18, wherein during operation of the telescopic system to extend or retract the lattice type telescopic boom section with respect to the lattice type base boom section, the boom hoisting system is controlled to follow the telescopic system to facilitate the movement of the lattice type telescopic boom section.

20. The method according to claim 18, wherein during operation of the telescopic system, a crane boom angle is approximately 80 degrees.

21. The method according to claim 18, wherein during operation of the telescopic system, a measurement system determines an actual position of the lattice type telescopic boom section with respect to the lattice type base boom section, wherein the measurement system provides output of a determined actual position to an output module.

22. The method according to claim 21, wherein, upon approaching a desired extended position, the measurement system controls a speed reduction of the telescopic system.

23. The method according to claim 22, wherein upon reaching the desired extended position, the at least one primary pin is inserted in the at least one corresponding primary pin receiving aperture.

* * * * *